US007192904B2

(12) United States Patent
Iwasaki et al.

(10) Patent No.: US 7,192,904 B2
(45) **Date of Patent: *Mar. 20, 2007**

(54) THERMAL RECORDING MATERIAL

(75) Inventors: Masayuki Iwasaki, Shizuoka (JP); Tsutomu Watanabe, Shizuoka (JP); Hirofumi Mitsuo, Shizuoka (JP); Hirokazu Kitou, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/499,433

(22) PCT Filed: Dec. 20, 2002

(86) PCT No.: PCT/JP02/13397

§ 371 (c)(1),
(2), (4) Date: Nov. 3, 2004

(87) PCT Pub. No.: WO03/053711

PCT Pub. Date: Jul. 3, 2003

(65) Prior Publication Data

US 2005/0054527 A1 Mar. 10, 2005

(30) Foreign Application Priority Data

Dec. 20, 2001 (JP) ..... 2001-387678
Dec. 20, 2001 (JP) ..... 2001-387679
Dec. 20, 2001 (JP) ..... 2001-387680
Dec. 20, 2001 (JP) ..... 2001-388132

(51) Int. Cl.
*B41M 5/30* (2006.01)

(52) U.S. Cl. ..... 503/216; 427/150; 503/209; 503/221

(58) Field of Classification Search ..... 427/150; 503/216, 209, 221
See application file for complete search history.

(56) References Cited

U.S. PATENT DOCUMENTS 3,897,998 A 8/1975 Someya et al.
4,414,259 A 11/1983 Tsuchiya et al.
5,068,133 A 11/1991 Matsumoto et al.
6,497,926 B1 12/2002 Yokota et al.
6,699,816 B2 * 3/2004 Iwasaki et al. ..... 503/209
6,852,671 B2 * 2/2005 Iwasaki et al. ..... 503/216

FOREIGN PATENT DOCUMENTS

| | | | |
|---|---|---|---|
| EP | 0 992 363 | A1 | 4/2000 |
| JP | 49024133 | A | 3/1974 |
| JP | 54-74761 | A | 6/1979 |
| JP | 57-212094 | A | 12/1982 |
| JP | 3-290285 | A | 12/1991 |
| JP | 4-105987 | A | 4/1992 |
| JP | 4-332682 | A | 11/1992 |
| JP | 5-104062 | A | 4/1993 |
| JP | 6179290 | A | 6/1994 |
| JP | 7-89237 | A | 4/1995 |
| JP | 7-314914 | A | 12/1995 |
| JP | 10-35103 | A | 2/1998 |
| JP | 11048610 | A | 2/1999 |
| JP | 11070736 | A | 3/1999 |
| JP | 11291633 | A | 10/1999 |
| JP | 2000-247038 | A | 9/2000 |
| JP | 2000247038 | A | 9/2000 |
| JP | 2000326632 | A | 11/2000 |
| JP | 2000-345067 | A | 12/2000 |
| JP | 2001-293956 | A | 10/2001 |
| JP | 2002-86910 | A | 3/2002 |
| JP | 2002-127604 | A | 5/2002 |
| JP | 2002127601 | A | 5/2002 |
| WO | WO 02/098673 | A1 | 12/2002 |
| WO | WO 03/002354 | A1 | 1/2003 |

* cited by examiner

*Primary Examiner*—B. Hamilton Hess
(74) *Attorney, Agent, or Firm*—Sughrue Mion, PLLC

(57) ABSTRACT

The present invention provides a heat-sensitive recording material comprising a substrate and a heat-sensitive recording layer provided thereon, the layer comprising a color forming system that combines an electron-donating colorless dye and an electron-accepting compound, in which the electron-accepting compound is a compound represented by the formula $R^1$-Ph-$SO_2R^2$ (wherein $R^1$ represents a hydroxyl group or an alkyl group, $R^2$ represents -Ph, —NH-Ph, -Ph-$OR^3$ or —NH—CO—NH-Ph, $R^3$ represents an alkyl group, and Ph represents a phenyl group), and at least the heat-sensitive recording layer is formed by curtain-coating a coating solution for the heat-sensitive recording layer.

20 Claims, No Drawings

THERMAL RECORDING MATERIAL

TECHNICAL FIELD

The present invention relates to a heat-sensitive recording material. Specifically, the invention relates to a heat-sensitive recording material having superior apparatus applicability so as to not cause deterioration of apparatus durability such as head abrasion, and the like; having photographic applicability and stability as a recording medium; having printing applicability, stamping applicability, environment applicability, and the like; and having usefulness as a plain paper-like recording medium.

BACKGROUND ART

Historically, dye-type heat-sensitive paper containing a colorless leuco dye and a phenolic acidic substance was developed as a heat-sensitive recording technology by NCR Inc. in the 1960s, and this system has become the mainstream of heat-sensitive recording systems. Thereafter, demand for heat-sensitive paper (hereinafter referred to as "heat-sensitive recording material") has increased rapidly since (1) miniaturization and price reduction of apparatuses became possible due to development of thermal heads based on semiconductor technologies and significant improvement in cost and performance; (2) increase in quality (higher sensitivity, improvement of head matching property, and the like) of heat-sensitive paper (heat-sensitive recording material) itself was realized; and (3) heat-sensitive recording systems were evaluated to be advantageous in view of user-friendliness, i.e., convenience, low costs, freedom from frequent maintenance, and the like as compared to other recording systems such as static recording, ink jet recording, PPC recording, and the like.

However, as heat-sensitive recording materials are used for facsimile machines, various printers, and the like and have become familiar to daily life, defects of heat-sensitive recording materials have also become well known. Namely, the following defects have been pointed out:

- discoloration by light;
- discoloration during storage at high temperature (when left in a vehicle, and the like);
- fading of a recorded image by chemical agents such as plasticizers in wrapping films, oils, organic solvents in marker pens, ink for ink jet printers, and the like;
- a lack of plain paper-like texture (good stamping applicability such as good drying of stamps without bleeding, and the like, a recording surface that is matted and easy to read, good writing property with respect to a pencil, and the like, resistance to stainining due to friction, and the like, and so forth).

Therefore, development and provision of a heat-sensitive recording material free from the above-mentioned defects and having high value have been demanded.

Recently, heat-sensitive recording materials have been widely used since they are relatively inexpensive and recording apparatuses therefore are compact and do not require frequent maintenance. Under such circumstances, competition in the marketing of heat-sensitive recording materials has become tough, and demand for heat-sensitive recording materials having higher performance that can be differentiated from conventional performance, and specifically heat-sensitive recording materials having high density of developed color, whiteness of background, sharpness, storage stability, good hue and sharpness for a full-color image recorded by an ink jet recording system, or the like has increased. Therefore, intensive investigations regarding various characteristics such as color developing property, storability, and the like of heat-sensitive recording materials are now being conducted in order to satisfy such demands.

The characteristics that heat-sensitive recording materials should have include, for example, (1) high sensitivity (capability to provide high density); (2) high whiteness of a background portion (non-printed portion) (low background fogging property); (3) superior image storability after photographic printing; (4) superior light fastness; (5) superior resistance to chemical substances; (6) sharpness and high image quality; (7) good hue and sharpness of colors for a full-color image recorded by an ink jet recording system; (8) good thermal head matching property and head resistance property by which thermal head abrasion is decreased; (9) plain paper-like feeling; (10) printing applicability that enables printing on a heat-sensitive recording layer, and stamping applicability free from bleeding; (11) applicability for high performance printers such as a high speed printer, and the like; and (12) environment applicability. Under the above-mentioned circumstances, it is demanded that all of these characteristics are simultaneously satisfied without deterioration of any of the characteristics. However, under the present circumstances, a heat-sensitive recording material that can satisfy all of the above-mentioned characteristics simultaneously has not been provided yet.

Conventionally, 2,2-bis(4-hydroxyphenyl)propane (so-called "bisphenol A") has been widely used as an electron-accepting compound that reacts with an electron-donating colorless dye to develop color used for a heat-sensitive recording material. However, in such a system, a heat-sensitive recording material having satisfactory properties in view of sensitivity, background fogging property, and image storability has not been provided yet.

Furthermore, such a system also has a problem in view of (13) ink jet applicability. Namely, full color information is sometimes recorded on a heat-sensitive recording material using inks for ink jet recording. However, when ink jet recording is carried out on a recording surface of a conventional heat-sensitive recording material containing bisphenol A, hues of inks cannot be reproduced faithfully, sharp hues cannot be obtained, and when an image is already formed on the recording surface by heat-sensitive recording, the image sometimes fades. Furthermore, when the above-mentioned conventional heat-sensitive recording material is placed in contact with a medium having an image recorded by an ink jet printer, background fogging or fading of a recorded image sometimes occurs.

DISCLOSURE OF INVENTION

The present invention aims at solving the above-mentioned conventional problems and achieving the following objects.

Namely, the object of the invention is to provide a heat-sensitive recording material capable of forming an image having high sensitivity and high density (having good printing applicability), capable of providing superior image storability after photographic printing, capable of preventing hue defect and blotting of ink jet image, having ink jet applicability accompanying no fading of image due to ink for ink jet printing, and having good thermal head matching property and providing little head abrasion and head contamination (having good head applicability) even used for a high quality printers that provides high speed or that has partial-glazed structure, and to provide a heat-sensitive recording material having performances of, besides the above-mentioned performances, capable of providing a sharp and high quality image, capable of providing superior light fastness of a formed image, capable of printing or stamping on a heat-sensitive recording layer or a protective layer without blotting, and capable of forming by a small coating amount at low cost (environment applicability), and if desired, capable of providing plane paper-like feeling.

The present inventors have done intensive studies on the technologies for satisfying the performances that a heat-sensitive recording material should have at high level simultaneously, and obtained the following findings.

<Provision of High Sensitivity>

In order to provide high sensitivity, the following (1) to (3) are important.

(1) Firstly, it is important to improve heat conduction from a thermal head to a heat-sensitive recording layer. For this purpose, it is effective to improve the surface smoothness of a recording surface of a heat-sensitive recording material and to provide cushioning property to the recording surface. (2) Secondly, it is important to utilize the heat conducted from the thermal head effectively. For this purpose, it is effective to athermalize a substrate and to thin down the heat-sensitive recording layer. (3) Thirdly, it is important to improve solubilization velocities of an electron-donating colorless dye and an electron-accepting compound in a sensitizer. For this purpose, it is effective to improve solubility, decrease the melt viscosity, and to decrease the particle size of the material. Hereinafter (1) to (3) are specifically explained.

(1) Improvement of Heat Conduction from a Thermal Tead to a Heat-sensitive Recording Layer Since a certain amount of heat is required to develop color on a heat-sensitive recording layer to a certain density, it is important to conduct the heat from the thermal head to the recording layer effectively in order to improve sensitivity of a heat-sensitive recording material. Heat conductivity of a solid substance is enormously higher than that of gas, and conducted heat is much higher than radiated heat. Therefore, it is effective to increase the contact interval of the surface of the heat-sensitive recording layer (hereinafter sometimes referred to as "recording surface") during photographic printing and the thermal head, and whereby the heat from the thermal head can be conducted effectively to the heat-sensitive recording layer.

In order to increase the contact ratio of the recording surface and the thermal head, it is specifically effective to [1] increase the smoothness of the recording surface in advance, and to [2] increase cushioning property of the heat-sensitive recording material, etc., as physical properties required in the heat-sensitive recording material.

[1] In order to increase smoothness of the recording surface, it is effective to improve the planarity of a substrate. Specifically, it is desirable to use base paper having high planarity and to provide a primer layer comprising an oil-absorbing pigment as a main component on a substrate for eliminating irregularity due to pulp, etc. Furthermore, it is effective to conduct heat calendar or super calendar treatment after applying the recording layer and drying in order to increase smoothness.

[2] Furthermore, the effectiveness of increasing the cushioning property of the heat-sensitive recording material (provision of cushioning property) is based on the following findings. That is, when heat photographic printing is carried out on a heat-sensitive recording material using a thermal head, a suitable pressure is applied using a platen roll. A heat-sensitive recording material that changes its shape easily is sufficient to increase the contact interval between the thermal head and the recording surface under the pressure. Therefore, it is effective to provide a primer layer containing an oil-absorbing pigment as a main component and incorporating a pigment having high oil-absorbing property in the heat-sensitive recording layer as specific means for providing cushioning property. Specifically, this concept for providing cushioning property is also effective for increasing sensitivity when recording is conducted using a thermal head having a partially-glazed structure. As used herein, the partially-glazed structure refers to a structure wherein the cross-section of a glazed layer of a heat generating portion has a convex (chevron) shape on a substrate.

(2) Effective Utilization of Heat Conducted from a Thermal Head

In order to utilize heat conducted from a thermal head effectively, it is effective to athermalize a substrate. Specific means for this purpose is to provide gaps as many as possible in the substrate. In the case of the heat-sensitive recording material, for example, the means includes providing a primer layer comprising a pigment having high oil-absorbing property to decrease the amount of a binder used in the primer layer as possible, incorporating hollow particles in the primer layer, etc.

Furthermore, it is effective to thin down the heat-sensitive recording layer in order to utilize heat effectively. Considering that the heat capacity of the heat-sensitive recording layer contributes to the sensitivity, the heat-sensitive recording layer contains many components those do not contribute to the development of color, and the heat capacities thereof are consumed unnecessarily. Such components include a releasing agent and wax, which suppress adhesion between the thermal head and the recording layer, an oil-absorbing pigment that absorbs melted components, binders for providing distribution of materials and film strength, etc. Since the heat consumption by these components extends to about 20% to 30%, it is expected to increase the sensitivity by about 10% to 15% by reducing the amount of these components by half.

According to the inventor's investigation, sensitivity can be increased by decreasing the amounts of a pigment and a binder in a recording layer. Since sensitivity can be increased unexpectedly by decreasing the amount of the binder, it is considered that the factors other than heat capacity contribute to the sensitivity. However, the reason why the sensitivity can be increased is not clarified yet. It should be noted that, however, when the amount of the binder is simply decreased, head matching property, film strength, etc. of the thermal head deteriorate. Accordingly, it is important to use effective incorporation ratio as possible, i.e., use desired components in a desired layer at the minimum amount.

(3) Improvement of the Solubilization Velocities of an Electron-donating Colorless Dye and an Electron-accepting Compound in a Sensitizer In the earlier step of the technical development in heat recording materials, a sensitizer has been selected as a melting point decreasing agent for an electron-donating colorless dye and an electron-accepting compound in order to develop a color at a lower temperature. However, in this concept, there is a limitation to increase the sensitivity while keeping color-development onset temperature, which makes difficult consistency between background fogging property and sensitivity. Accordingly, the inventors have considered a sensitizer as a material for solubilizing an electron-donating colorless dye and an electron-accepting compound and have done investigation on a sensitizer that realizes high sensitivity while keeping background fogging property at low level without decreasing the co-melting point unnecessarily, and obtained a finding that it is more advantageous for increasing sensitivity to diffuse the electron-donating colorless dye and the electron-accepting compound in the melted sensitizer more rapidly. Accordingly, it is advantageous and preferable for increasing sensitivity to select a sensitizer having not only high solubility but also low melt viscosity, and to decrease the diffusion particle size of the electron-donating colorless dye and the electron-accepting compound. It should be noted that, however, when the diffusion particle size is too small, the background fogging property becomes worse, and therefore, it is important to select a suitable size.

<Provision of Matching Property with a Thermal Head, and Head Durability>

A heat-sensitive recording material is subjected to photographic printing (printing), wherein a thermal head, which is a heat generating element, contacts directly to the recording surface thereof (surface of the heat-sensitive recording layer) and rubs the surface. Accordingly, the components in the melted recording layer sometimes adhere to the head and deposit as smudges thereon. Furthermore, the lifetime of the head as it is sometimes shortened by physical abrasion or corrosion, etc. of the surface of the thermal head.

Accordingly, it is desirable to apply the following means.

1) In view of prevention of head contamination, it is important to absorb and keep the substances such as a dye, a developer, a sensitizer, etc., each of which is melted by heat, on the surface of the material. For this purpose, it is effective to use a pigment having high oil-absorbing property for the recording layer, or to provide a primer layer comprising a pigment having high oil-absorbing property, etc.

2) Furthermore, it is important to suppress content of ions ($Na^+$, $K^+$, etc.) in the components constituting the recording material, since the ions cause corrosion of the head easily.

3) In view of decreasing of physical abrasion as much as possible, it is important to consider hardness, shape, particle size, etc. of a pigment.

<Compatibility of Image Retention Property (and Chemical Resistance) and Background Fogging>

A developed image is specifically vulnerable to moisture, and is easy to come off by the effect of heat or a reverse reaction by chemical agents such as oils and fats, plasticizers, etc. since the chemical reaction that occurs by heat melt and contact of a leuco dye and a developer, which is a principle of color development of a heat-sensitive recording material, is a reversible reaction. Accordingly, problems in view of heat resistance, image retention property (specifically moisture resistance) and chemical resistance, such as problems that the developed image comes off by heat or moisture during storage, by touching by a hand on which a hand cream, other cosmetics or oil and fat has been adhered, or by standing the image contacting with a plastic product comprising a plasticizer, a product comprising an organic solvent or a leather product (an eraser, a desk mat made of vinyl chloride, food wrapping film, a marker pen, ink for ink jet, a wallet, a commuter-pass holder, etc.) in daily life, are tend to take place.

In order to overcome the above-mentioned phenomenon due to the color development principle (coming off and fading of image), many investigations have been done. For example, [1] a method comprising making so-called an overcoat type material by forming a protective layer on a recording layer for the purpose of physical shielding, [2] a method comprising adding additives such as a cross-linking agent to a recording layer, etc. have been done. However, even a protective layer is provided, effects by heat and moisture can not be suppressed completely. Furthermore, fading over time by gradual permeation of oil or a plasticizer can not be avoided. As a result, a heat-sensitive recording material has problems that the usage of the material is limited to short-time application such as measuring labels to be adhered to perishable foods sold in supermarkets, etc., and that the effect of the color development requires considerably long time to be exhibited even a cross-linking substance is added, etc. Therefore, storage property, which is a basic performance has not been satisfied yet.

Accordingly, the inventors have investigated on improvement of storage property, and as a result, obtained findings that a specific electron-accepting compound is useful for improvement of image retention property as well as background fogging, and that background fogging can be further improved by combining the compound with a specific sensitizer and an electron-donating colorless dye. Furthermore, the inventors obtained a finding that image retention property and light fastness can be improved by combining the compound with a specific image stabilizer without deteriorating background fogging. According to these findings, it is also possible to provide image retention property together with stamping applicability and handling property at high level, which is difficult by a conventional technique for providing storage property depending on an overcoat. Accordingly, stamping applicability and image retention property can be achieved simultaneously.

<Improvement of Light Fastness>

A heat-sensitive recording material having superior light fastness is sometimes required for some applications. However, since a leuco dye, which is responsive for image forming, easily decompose by ultraviolet light, etc., and also fades after a long time exposure of natural light. Therefore, the material comprising a leuco dye has a problem in view of light fastness.

In order to improve light fastness, it is important to provide a means for preventing decomposition of a leuco dye by light. For this purpose, it is effective to incorporate an ultraviolet light absorber (an image stabilizer), which prevents ultraviolet light that specifically provides high level energy, in a heat-sensitive recording layer or a protective layer. Specifically, it is more effective to incorporate a liquid ultraviolet light absorber in microcapsules or in a protective layer in view of effective blockage of ultraviolet light before it arrives at the heat-sensitive recording layer.

<Provision of Printing Applicability>

Offset printing is sometimes provided on a recording surface of a heat-sensitive recording material (surface of a heat-sensitive recording layer) depending on application. For such application, the material is required to have surface strength that can stand up to more than 100 m/min of printing velocity of a rotary form printing machine and wetting water absorbing property. For this purpose, it is important to optimize the incorporation ratio of a pigment and a binder in a heat-sensitive recording layer. Preferable pigment for this purpose is an oil-absorbing pigment such as calcium carbonate, etc. Preferable binder for this purpose is polyvinyl alcohol (PVA), and sulfo-modified polyvinyl alcohol, diacetone-modified polyvinyl alcohol and acetoacetyl-modified polyvinyl alcohol are specifically preferred.

<Provision of Plain Paper-like Feeling>

As a result of wide use of a heat-sensitive recording material as recording paper for facsimiles at office and home and as recording paper for various printers, problem that the material provides uncomfortable feeling, i.e., smooth-faced feeling, bad writing property, thinness and unsufficient elasticity when holding by a hand have been pointed out actively in comparison with general paper (PPC paper, and quality paper such as notebook, writing paper, etc.). This is one of the reasons why facsimiles used in offices are recently replaced with PPC type facsimiles using regular paper. In view of these points, it is important to provide hand feeling and user-friendliness close to those of quality paper to a heat-sensitive recording material by [1] thickening body paper that is used as a substrate to improve elasticity, or by [2] providing a protective layer to provide low surface gloss, writing property and stamping applicability, etc.

As used herein, a heat-sensitive recording material having plain paper-like feeling is considered to have no defects of converted paper which the conventional heat-sensitive paper has, have a matte surface, have no slimy feeling of hand feeling, and to have resistance to abrasion contamination and resistance to fading of a recorded image, etc. Accordingly, materials having a protective layer on a recording layer have been suggested for providing plane paper-like feeling. However, conventional protective layers were provided too much consideration on hand feeling, appearance (matte), writing property, etc., and were not provided any consideration regarding stamping applicability.

However, the inventors have considered that stamping applicability (no blotting, good drying of stamped image, etc.) is specifically important in view of traditional custom in Japan, and have investigated improvement of a protective layer for a heat-sensitive recording material having plain paper-like property.

As a result, the inventors obtained a finding that the following materials are useful for a pigment and a binder for a protective layer in order to obtain plain paper-like feeling including stamping applicability.

As the above-mentioned pigment, those having suitable particle size, oil-absorption amount and stamping applicability are preferred since stamping property, appearance (matte) and writing property are considered to be important. When the matte particle size is too large, image quality sometime becomes worse, and when the particle size is too small, writing property and appearance sometimes become worse. Furthermore, when the oil-absorption amount is too large, opacity of the protective layer increases, which leads to decrease of recording density, and when the oil-absorption amount is too small, stamping applicability (drying) tends to become worse.

As the above-mentioned binder, those obtained by mixing PVA and starch in a suitable ratio are preferable in order to prevent deterioration of stamping applicability (bleeding). As the above-mentioned PVA, those so called completely-saponified type PVA (having saponification degree of about 93% or more) are preferable in view of providing deterioration of stamping applicability (drying).

<Provision of High Sensitivity and Head Matching Property in Combination with Apparatus>

The reason why heat-sensitive recording materials have been applied to many fields and applications recently is that heat-sensitive recording systems have advantages such as compactness, low running cost, maintenance-free, and that technical improvements have been studied on both printers (hardware) and recording paper (medium). In view of hardware, for example, high performance printers such as those providing recording speed of 10 inches (about 25 cm)/sec, recording width of A0 size (about 900 mm) at maximum and resolution of 600 dpi (24 dot/mm) have emerged, which takes a place beside conventional dot printers and laser printers. Therefore, it is important for hardware to combine technologies according to application and to constitute hardware so as to have optimal design and controlling means.

Accordingly, preferable high performance printer specifically includes a high speed printer that provides recording velocity of not less than 10 cm/sec, a printer comprising a thermal head having partially-glazed structure, etc. However, when a conventional heat-sensitive recording material is combined with the high speed printer that provides recording velocity of not less than 10 cm/sec, sensitivity is sometimes insufficient, and when it is combined with the printer comprising a thermal head having partially-glazed structure, head contamination tends to occur.

Accordingly, the inventors have investigated optimal design of a heat-sensitive recording material, and obtained a finding that when a specific developer (an electron-accepting compound) is selectively used for the material, the material can exhibit high sensitivity and good head matching property while satisfying the above-mentioned performances required for a heat-sensitive recording material at high level even when the material is specifically combined with the high speed printer that provides recording velocity of not less than 10 cm/sec or the printer comprising a thermal head having partially-glazed structure.

<Improvement of Image Quality>

For hardware (apparatuses) using a heat-sensitive recording material, quality of recorded image is sometimes important as in the case of receiving a photograph by a facsimile, etc. Regarding improvement of the quality of recorded image, the inventors obtained a finding that it is effective to provide a primer layer comprising an oil-absorbing pigment as a main component, specifically to apply a primer layer by curtain coating method or blade coating method (specifically by blade coating method) for improving image quality.

<Decrease of Environmental Burden>

Recently, a system that provides low burden on environment is socially required, and it is no exception for the field of a heat-sensitive recording materials. In order to decrease environmental burden, it is important to satisfy the required performances using lesser amount of materials and lesser amount of energy. For this purpose, the inventors obtained findings that applying a heat-sensitive recording layer, etc. by curtain coating method is effective in view of improvement of color development density, and that applying plural of layers simultaneously to form multi-layered structure is effective in view of decreasing energy consumption during drying and handling. Accordingly, same color development density as before can be obtained by using lower amount of materials and lower energy.

It is considered more effective to reduce a coating amount of the coating layer as small as possible, by uniformly providing the coating layer on the substrate, such that the heat sensitive recording material can be produced with a lower production cost. The present inventors have found, through intensive studies, that it is effective for the purpose of reducing the coating amount of the coating layer to apply coating by a curtain coating method. It was also found that the surface of the coating layer becomes smooth and incidents of defected coating layers can be reduced by designing the coating solution to have specific characteristics, in order to produce the heat sensitive recording material with a low cost. It was also found from intensive studies on a drying method that a heat sensitive recording material having higher whiteness can be obtained by adjusting a highest surface temperature of the coating layer at not more than 65° C. during a constant rate drying process. Intensive studies on coating conditions have proved that a heat sensitive recording material having a good surface state without causing coating defects can be produced by adjusting a coating speed at 200 to 2,000 n/minute and specifying a falling speed of the coating solution in the form of a film at a coating point within 1/40 to 1 time of the coating speed. The present invention has been accomplished based on the above-described discoveries and provides the following.

According to a first aspect, the invention provides a heat sensitive recording material comprising a substrate having disposed thereon a heat sensitive recording layer that contains an electron-donating colorless dye and an electron-accepting compound which is capable of reacting with the electron-donating colorless dye to develop color and is represented by the following formula (1), wherein at least the heat sensitive recording layer is formed by curtain coating of a coating solution:

$$R^1\text{-Ph-}SO_2R^2 \qquad \text{Formula (1)}$$

wherein $R^1$ represents a hydroxyl group or an alkyl group; $R^2$ represents -Ph-, —NH-Ph, -Ph-$OR^3$ or —NH—CO—NH-Ph; $R^3$ represents an alkyl group; and Ph represents a phenyl group that may be substituted with a substituent comprising —$SO_2R^2$.

According to a second aspect, the invention provides a heat sensitive recording material comprising a substrate having disposed thereon a heat sensitive recording layer that contains an electron-donating colorless dye and an electron-accepting compound that is capable of reacting with the electron-donating colorless dye to develop color and is represented by the following formula (1), wherein at least the heat sensitive recording layer is formed by applying a coating solution by curtain coating, and a viscosity of the coating solution ranges from 30 to 300 mPa·s:

$$R^1\text{-Ph-}SO_2R^2 \qquad \text{Formula (1)}$$

wherein $R^1$ represents a hydroxyl group or an alkyl group; $R^2$ represents -Ph-, —NH-Ph, -Ph-$OR^3$ or —NH—CO—NH-Ph; $R^3$ represents an alkyl group; and Ph represents a phenyl group that may be substituted with a substituent comprising —$SO_2R^2$.

The heat sensitive recording material according to the second aspect of the invention can provide high sensitivity while suppressing background fogging and exhibit long-term storability of the formed image (hereinafter referred to as "image storability"), enhanced chemical resistance and improved head matching property of the thermal head, since the electron-accepting compound represented by formula (1) is used as one of the color-developing components. Further, the coating amount of the coating solution can be reduced with retaining a good surface state of the coating layer, since at least the heat sensitive recording layer is formed by curtain coating, and the viscosity of the coating solution constituting the coating layers including the heat sensitive recording layer ranges from 30 to 300 mPa·s.

According to a third aspect, the invention provides a heat sensitive recording material of the second aspect, in which the heat recording layer is formed with a coating amount of 5 g/$m^2$ or less.

The heat sensitive recording material according to the third aspect of the invention can further reduce burdens on the environment, since the amount of materials and energy used for drying can be reduced.

According to a fourth aspect, the invention provides a heat sensitive recording material of the second aspect, in which the coating solution has a surface tension of 25 to 50 mN/m.

The heat sensitive recording material according to the fourth aspect of the invention can provide a stable curtain film, thereby providing a good surface state of the coating layer.

According to a fifth aspect, the invention provides a heat sensitive recording material of the second aspect, in which a compound represented by formula (1) is 4-hydroxybenzene sulfonanilide.

The heat sensitive recording material according to the fifth aspect of the invention can exhibit increased sensitivity, and provide improved image storability and enhanced head matching property more effectively while suppressing background fogging (fogging density at a background area), since the heat sensitive recording material contains 4-hydroxybenzene sulfonanilide as the electron-accepting compound.

According to a sixth aspect, the invention provides a heat sensitive recording material of the second aspect, in which a protective layer is disposed on the heat sensitive recording layer and comprises at least one inorganic pigment selected from aluminum hydroxide, kaolin and amorphous silica, in combination with a water-soluble polymer.

The heat sensitive recording material according to the sixth aspect of the invention can exhibit improved storability due to its oil absorbing property and provide increased handling performance and good printability (plain paper-like feeling), since the protective layer containing the specific inorganic pigment is formed on the heat sensitive recording layer.

According to a seventh aspect, the invention provides a heat sensitive recording material of the second aspect, in which the heat sensitive recording layer contains a sensitizer that is at least one selected from 2-benzyloxynaphthalene, dimethylbenzyl oxalate, m-terphenyl, ethyleneglycol tolylether, p-benzyl biphenyl, 1,2-diphenoxymethyl benzene, diphenyl sulfone and 2-diphenoxyethane.

The heat sensitive recording material according to the seventh aspect of the invention can effectively exhibit high sensitivity by satisfactorily diffusing the color-developing components through a reduced viscosity of the coating solution while suppressing background fogging, since the heat sensitive recording layer contains a specific sensitizer.

According to an eighth aspect, the invention provides a heat sensitive recording material of the second aspect, in which the electron-donating colorless dye is at least one selected from 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorane.

The heat sensitive recording material according to the eighth aspect of the invention can further exhibit increased sensitivity, reduced background fogging and improved storability, since the heat sensitive recording layer contains the specific electron-donating colorless dye.

According to a ninth aspect, the invention provides a heat sensitive recording material comprising a substrate having disposed thereon a heat sensitive recording layer that contains an electron-donating colorless dye and an electron-accepting compound that is capable of reacting with the electron-donating colorless dye to develop color and is represented by the following formula (1), wherein at least the heat sensitive recording layer is formed by curtain coating of a coating solution and is dried at a highest surface temperature of 65° C. or lower during a constant rate drying process:

$$R^1\text{-Ph-}SO_2R^2 \qquad \text{Formula (1)}$$

wherein $R^1$ represents a hydroxyl group or an alkyl group; $R^2$ represents -Ph-, —NH-Ph, -Ph-$OR^3$ or —NH—CO—NH-Ph; $R^3$ represents an alkyl group; and Ph represents a phenyl group that may be substituted with a substituent comprising —$SO_2R^2$.

The heat sensitive recording material according to the ninth aspect of the invention can exhibit high sensitivity while suppressing background fogging and provide improved long-term storability of the image formed (hereinafter referred to as "image storability"), good chemical resistance and enhanced head matching property of the thermal head, since the electron-accepting compound represented by formula (1) is used as one of the color-developing components. Furthermore, the coating amount of the coating solution can be reduced while increasing a whiteness degree, since the heat sensitive recording layer is formed by curtain coating of the coating solution, and the heat sensitive recording layer is dried at the highest temperature of 65° C. or lower during the constant rate drying process.

According to a tenth aspect, the invention provides a heat sensitive recording material of the ninth aspect, in which the compound represented by formula (1) is 4-hydroxybenzene sulfonanilide.

The heat sensitive recording material according to the tenth aspect of the invention can exhibit increased sensitivity and provide improved image storability and good head matching property more effectively while suppressing background fogging (fogging density at the background area), since the heat sensitive recording layer contains 4-hydroxybenzene sulfonanilide as the electron-accepting compound.

According to an eleventh aspect, the invention provides a heat sensitive recording material of the ninth aspect, in which the heat sensitive recording layer contains a sensitizer that is at least one selected from 2-benzyloxynaphthalene, dimethylbenzyl oxalate, m-terphenyl, ethyleneglycol tolylether, p-benzyl biphenyl, 1,2-diphenoxymethylbenzene, diphenyl sulfone and 1,2-diphenoxyethane.

The heat sensitive recording material according to the eleventh aspect of the invention can effectively exhibit high sensitivity by satisfactorily diffusing the color-developing components through a reduced viscosity of the coating solution while suppressing background fogging, since the heat sensitive recording layer contains a specific sensitizer.

According to a twelfth aspect, the invention provides a heat sensitive recording material of the ninth aspect, in which the electron-donating colorless dye is at least one selected from 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorane.

The heat sensitive recording material according to the twelfth aspect of the invention can exhibit further increased sensitivity, reduced background fogging and improved storability, since the heat sensitive recording layer contains the specific electron-donating colorless dye.

According to a thirteenth aspect, the invention provides a heat sensitive recording material comprising a substrate having disposed thereon a heat sensitive recording layer that contains an electron-donating colorless dye and an electron-accepting compound that is capable of reacting with the electron-donating colorless dye to develop color and is represented by the following formula (1), wherein at least the heat sensitive recording layer is formed by curtain coating at a coating speed of 200 to 2,000 m/minute and specifying a falling speed of a coating solution in the form of a film at the coating point within 1/40 to 1 time of the coating speed:

$$R^1\text{-Ph-}SO_2R^2 \qquad \text{Formula (1)}$$

wherein $R^1$ represents a hydroxyl group or an alkyl group; $R^2$ represents -Ph-, —NH-Ph, -Ph-$OR^3$ or —NH—CO—NH-Ph; $R^3$ represents an alkyl group; and Ph represents a phenyl group that may be substituted with a substituent comprising —$SO_2R^2$.

The heat sensitive recording material according to the thirteenth aspect of the invention can exhibit high sensitivity, long-term storability of the image formed (hereinafter referred to as "image storability"), improved chemical resistance and enhanced head matching property of a thermal head while suppressing background fogging, since the electron-accepting compound represented by formula (1) is used as one of the coloring components. Furthermore, the amount of coating of the coating solution can be reduced and the surface state of the coating layer can be improved without causing coating defects when at least the heat sensitive recording layer is formed by curtain coating at a coating speed of 200 to 2,000 m/minute and specifying a falling speed of a coating solution in the form of a film at the coating point within 1/40 to 1 time of the coating speed.

According to a fourteenth aspect, the invention provides a heat sensitive recording material of the thirteenth aspect, in which the compound represented by formula (1) is 4-hydroxybenzene sulfonanilide.

The heat sensitive recording material according to the fourteenth aspect of the invention can provide increased sensitivity, long-term storability of the image formed and enhanced head matching property of a thermal head more effectively without causing enhanced background fogging (fogging density at the background portion), since the heat sensitive recording layer contains 4-hydroxybenzene sulfonanilide as the electron-accepting compound.

According to a fifteenth aspect, the invention provides a heat sensitive recording material of the thirteenth aspect, in which the heat sensitive recording layer contains a sensitizer that is at least one selected from 2-benzyloxynaphthalene, dimethylbenzyl oxalate, m-terphenyl, ethyleneglycol tolylether, p-benzyl biphenyl, 1,2-diphenoxymethylbenzene, diphenyl sulfone and 1,2-diphenoxyethane.

The heat sensitive recording material according to the fifteenth aspect of the invention can effectively exhibit high sensitivity by satisfactorily diffusing the color-developing components through a reduced viscosity of the coating solution while suppressing background fogging, since the heat sensitive recording layer contains the specific sensitizer.

According to a sixteenth aspect, the invention provides a heat sensitive recording material of the thirteenth aspect, in which the electron-donating colorless dye is at least one selected from 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorane.

The heat sensitive recording material according to the sixteenth aspect of the invention can exhibit further increased sensitivity, reduced background fogging and improved storability, since the heat sensitive recording layer contains the specific electron-donating colorless dye.

According to a seventeenth aspect, the invention provides a heat sensitive recording material comprising a substrate having disposed thereon a heat sensitive recording layer that contains an electron-donating colorless dye and an electron-accepting compound that is capable of reacting with the electron-donating colorless dye to develop color and is represented by the following formula (1), wherein at least the heat sensitive recording layer is formed by curtain coating of a coating solution, and a central line average roughness ($R_{a75}$) at a surface of the heat sensitive recording layer is 2.0 μm or less:

$$R^1\text{-Ph-}SO_2R^2 \qquad \text{Formula (1)}$$

wherein $R^1$ represents a hydroxyl group or an alkyl group; $R^2$ represents -Ph-, —NH-Ph, -Ph-$OR^3$ or —NH—CO—NH—-Ph; $R^3$ represents an alkyl group; and Ph represents a phenyl group that may be substituted with a substituent comprising —$SO_2R^2$.

The heat sensitive recording material according to the seventeenth aspect of the invention can exhibit high sensitivity while suppressing background fogging and provide long-term storability of the image formed, improved chemical resistance and enhanced head matching property of the thermal head, since the electron-accepting compound represented by formula (1) is used as one of the color-developing components. Furthermore, since the central line average roughness ($R_{a75}$) at the surface of the heat sensitive recording layer is 2.0 μm or less, sensitivity of the heat sensitive recording layer can be increased while reducing non-uniformity of color development and suppressing background fogging. As a result, long-term storability of the image formed, chemical resistance and head matching property of the thermal head as well as ink-jet printing applicability can be simultaneously improved. Moreover, since at least one of multiple layers, particularly the heat sensitive recording layer, is formed by curtain coating, constituting components can be concentrated on a recording surface to thereby augment color developing density and improve image quality with a smaller amount of used materials. Energy consumption may be reduced in a production process when multiple layers are simultaneously applied by curtain coating.

The term "heat sensitive recording surface" as used herein refers to an outermost surface (a surface of the layer provided at the remotest layer from the substrate) of the heat sensitive recording material to which heat is applied via a thermal head for forming an image. When other layers, such as a protective layer, is formed on the surface of the heat sensitive recording layer or on the heat sensitive recording layer, the heat sensitive recording surface refers to a surface of a layer provided at the outermost side (the remotest side from the substrate) among the other layers.

According to an eighteenth aspect, the invention provides a heat sensitive recording material of the seventeenth aspect, in which the central line average roughness ($R_{a75}$) at the heat sensitive recording surface ranges from 0.5 to 2.0 μm.

The heat sensitive recording material according to the eighteenth aspect of the invention can prevent printed letters from blurring due to non-uniform color development at printed portions, by adjusting the central line average roughness ($R_{a75}$) at the heat sensitive recording surface within an optimum range of 0.5 to 2.0 μm.

According to a nineteenth aspect, the invention provides a heat sensitive recording material of the seventeenth aspect, in which the compound represented by formula (1) is 4-hydroxybenzene sulfonanilide.

The heat sensitive recording material according to the nineteenth aspect of the invention can provide increased sensitivity, improved storability of the image formed and enhanced head matching property of the thermal head more effectively without causing enhanced background fogging (fogging density at the background portion), since the heat sensitive recording layer contains 4-hydroxybenzene sulfonanilide as the electron-accepting compound.

According to a twentieth aspect, the invention provides a heat sensitive recording material of the seventeenth aspect, in which the heat sensitive recording layer contains an inorganic pigment that is at least one selected from calcite-structured (light) calcium carbonate, amorphous silica and aluminum hydroxide.

The heat sensitive recording material according to the twentieth aspect of the invention can provide an enhanced head matching property suitably to contact with the thermal head and impart good printability to the heat sensitive recording layer, since the heat sensitive recording layer contains the specific inorganic pigment.

According to a twenty-first aspect, the invention provides a heat sensitive recording material of the seventeenth aspect, in which the substrate comprises a used waste paper pulp.

The heat sensitive recording material according to the twenty-first aspect of the invention can re-use and save on natural resources, since the waste paper pulp is used for the support.

According to a twenty-second aspect, the invention provides a heat sensitive recording material of the seventeenth aspect, in which a protective layer is formed on the heat sensitive recording layer and comprises at least one inorganic pigment selected from aluminum hydroxide, kaolin and amorphous silica, in combination with a water-soluble polymer.

The heat sensitive recording material according to the twenty-second aspect of the invention can exhibit enhanced storability due to its oil-absorbing property and provide excellent handling ability and increased printability (plain paper-like feeling), since the protective layer containing the specific inorganic pigment is formed on the heat sensitive recording layer.

According to a twenty-third aspect, the invention provides a heat sensitive recording material of the seventeenth aspect, in which the heat sensitive recording layer contains a sensitizer that is at least one selected from 2-benzyloxynaphthalene, dimethylbenzyl oxalate, m-terphenyl, ethyleneglycol tolylether, p-benzyl biphenyl, 1,2-diphenoxymethylbenzene, diphenyl sulfone and 1,2-diphenoxyethane.

The heat sensitive recording material according to the twenty-third aspect of the invention can effectively exhibit high sensitivity by satisfactorily diffusing the color-developing components through a reduced viscosity of the coating solution while suppressing background fogging, since the heat sensitive recording layer contains the specific sensitizer.

According to a twenty-fourth aspect, the invention provides a heat sensitive recording material of the seventeenth aspect, in which the electron-donating colorless dye is at least one selected from 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorane.

The heat sensitive recording material according to the twenty-fourth aspect of the invention can provide further increased sensitivity, reduced background fogging and improved storability, since the heat sensitive recording layer contains the specific electron-donating colorless dye.

BEST MODE FOR CARRYING OUT THE INVENTION

The heat sensitive recording material according to the first aspect of the present invention comprises a heat sensitive recording layer having a color developing system in combination of an electron-donating colorless dye and an electron-accepting compound, wherein the electron-accepting compound is represented by the formula $R^1$-Ph-$SO_2R^2$, and at least the heat sensitive recording layer is formed by curtain coating of a coating solution.

The heat sensitive recording material according to the second aspect of the present invention comprises a heat sensitive recording layer having a color developing system in combination of an electron-donating colorless dye and an electron-accepting compound, wherein the electron-accepting compound is represented by the formula $R^1$-Ph-$SO_2R^2$, and at least the heat sensitive recording layer is formed by curtain coating of a coating solution, and the viscosity of the coating solution constituting the coating layers ranges from 30 to 300 mPa·s.

The heat sensitive recording material according to the ninth aspect of the present invention comprises a heat sensitive recording layer having a color developing system in combination of an electron-donating colorless dye and an electron-accepting compound, wherein the electron-accepting compound is represented by the formula $R^1$-Ph-$SO_2R^2$, and at least the heat sensitive recording layer is formed by curtain coating of a coating solution, and is dried at a highest surface temperature of 65° C. or lower during a constant rate drying process:

The heat sensitive recording material according to the thirteenth aspect of the present invention comprises a heat sensitive recording layer having a color developing system in combination of an electron-donating colorless dye and an electron-accepting compound, wherein the electron-accepting compound is represented by the formula $R^1$-Ph-$SO_2R^2$, and at least the heat sensitive recording layer is formed by curtain coating of a coating solution at a coating speed of 200 to 2,000 m/minute and specifying a falling speed of a coating solution in the form of a film at the coating point within 1/40 to 1 time of the coating speed:

The heat sensitive recording materials according to the seventeenth aspect of the present invention comprises a heat sensitive recording layer having a color developing system in combination of an electron-donating colorless dye and an electron-accepting compound, wherein the electron-accepting compound is represented by the formula $R^1$-Ph-$SO_2R^2$, and at least the heat sensitive recording layer is formed by curtain coating of a coating solution, and the central line average roughness ($R_{a75}$) at the surface of the heat sensitive recording layer is 2.0 μm or less, Hereinafter, the heat sensitive recording material of the present invention is described in detail.

The heat sensitive recording material according to the first, second, ninth, thirteenth, and seventeenth aspects of the present invention has one or two or more heat sensitive recording layers on a substrate, and preferably a protective layer. Further, the material may have other layers such as an intermediate layer, if necessary.

<Heat-sensitive Recording Layer>

The heat-sensitive recording layer comprises at least an electron-donating colorless dye and an electron-accepting compound that reacts with an electron-donating colorless dye to develop color, and preferably comprises an image stabilizer (an ultraviolet light blocking agent), an inorganic pigment, an adhesive and a sensitizer. If required, the layer may comprise other components.

-Electron-donating Colorless Dye-

The heat-sensitive recording layer used for the invention comprises an electron-donating colorless dye as a color-developing component. The electron-donating colorless dye can be selected from conventionally known dyes, and for example, 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane, 2-anilino-3-methyl-6-(N-ethyl-N-p-tolylamino)fluorane, 2-anilino-3-methyl-6-N-ethyl-N-sec-butylaminofluorane, 3-di-(n-pentylamino)-6-methyl-7-anilinofluorane, 3-(N-isoamyl-N-ethylamino)-6-methyl-7-anilinofluorane, 3-(N-n-hexyl-N-ethylamino)-6-methyl-7-anilinofluorane, 3-[N-(3-ethoxypropyl)-N-ethylamino]-6-methyl-7-anilinofluorane, 3-di-(n-butylamino)-7-2-chloroanilino)fluorane, 3-diethylamino-7-(2-chloroanilino)fluorane, 3-(N-cyclohexyl-N-methylamino)-6-methyl-7-anilinofluorane, etc., can be exemplified.

Among these, it is specifically preferable to use at least one kind selected from the group consisting of 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorane. In addition, these electron-donating colorless dyes can be used solely or in combination of two or more in a single heat-sensitive recording layer.

Specifically, since the layer comprises at least one kind of dye selected from the above-mentioned group as an electron-donating colorless dye, color development density can be increased while keeping background fogging low. At the same time, it can further improve the image retention property formed image part.

During preparation of a coating solution for forming a heat-sensitive recording layer (hereinafter sometimes referred to as "coating solution for a heat-sensitive recording layer"), the particle size (volume mean diameter) of the electron-donating colorless dye is preferably not more than 1.0 μm, and more preferably 0.4–0.7 μm. When the volume mean diameter exceeds 1.0 μm, heat sensitivity sometimes decreases, and when the volume mean diameter is less than 0.4 μm, background fogging sometimes deteriorates.

The volume mean diameter can be measured easily by a laser diffraction type size distribution measuring instrument (e.g., trade name: LA500, manufactured by Horiba, Inc.), etc.

The coating amount of the electron-donating colorless dye is preferably 0.1–1.0 g/m$^2$, and more preferably 0.2–0.5 g/m$^2$ in view of color development density and background fogging.

-Electron-accepting Compound-

The heat-sensitive recording layer according to the present invention comprises at least one kind of the compound represented by the General formula (1) as an electron-accepting compound that reacts with the electron-donating colorless dye during heating to develop color. By comprising the compound as an electron-accepting compound, sensitivity can be increased while keeping background fogging low. Furthermore, long-term storage properties of the formed image (image retention property, chemical resistance, and head matching property of a thermal head) can be improved simultaneously.

General Formula (1):

$$R^1\text{-Ph-}SO_2R^2$$

wherein $R^1$ represents a hydroxyl group or an alkyl group, $R^2$ represents -Ph, —NH-Ph, -Ph-$OR^3$ or —NH-CO—NH-Ph, and $R^3$ represents an alkyl group, wherein Ph represents a phenyl group, which is optionally substituted by a substituent substituted with —$SO_2R^2$.

The alkyl group represented by $R^1$ is preferably an alkyl group having 1 to 3 carbon atoms, and more preferably a methyl group, an ethyl group, an isopropyl group, etc. Among these, $R^1$ is specifically preferably a hydroxyl group.

The $R^3$ represents an alkyl group, and the alkyl group is preferably an alkyl group having 1–4 carbon atoms, and specifically preferably an isopropyl group, etc. Ph may be a substituted phenyl group wherein the phenyl group is substituted by the "substituent substituted with —$SO_2R^2$", and the $R^2$ of the substituent may be substituted with a methyl group, a halogen atom, etc. The substituent includes —$CH_2$—$C_6H_5$—NHCONH—$SO_2$—$C_6H_5$, —$SO_2$—$C_6H_4$—$CH_3$, —$SO_2$—$C_6H_4$—Cl, etc.

Among these, $R^2$ is preferably —NH-Ph, and specifically preferably —NH—$C_6H_5$.

Preferable examples of the compound represented by the General formula (1) include 4-hydroxybenzenesulfoneanilide (=p-N-phenylsulfamoylphenol), p-N-2-chlorophenyl)sulfamoylphenol, p-N-3-tolylsulfamoylphenol, p-N-2-tolylsulfamoylphenol, p-N-(3-methoxyphenyl)sulfamoylphenol, p-N-(3-hydroxyphenyl)sulfamoylphenol, p-N-(4-hydroxyphenyl)sulfamoylphenol, 2-chloro-4-N-phenylsulfamoylphenol, 2-chloro-4-N-(3-hydroxyphenyl)sulfamoylphenol, 4'-hydroxy-p-toluenesulfoneanilide, 4,4'-bis(P-toluenesulfonylaminocarbonylamino)diphenylmethane (=BTUM), 4-hydroxy-4'-isopropoxydiphenylsulfone, etc. In addition, in the second to fourth aspect of the invention, 2,4-bis (phenylsulfonyl)phenol is also exemplified. However, in the invention, the compound is not limited to these compounds.

Among the electron-accepting compounds represented by the General formula (1), 4-hydroxybenzenesulfoneanilide is the most preferable in view of the balance between image retention property, and background fogging.

The content of the electron-accepting compound in a single heat-sensitive recording layer is preferably 50–400% by mass, more preferably 100–300% by mass relative to the mass of the electron-donating colorless dye.

Besides the electron-accepting compound represented by the General formula (1), other known electron-accepting compounds may be used in combination so long as the effects of the invention (specifically decrease of background fogging, improvement of sensitivity, and improvements of moisture resistance and image retention property, chemical resistance and head matching property) are not deteriorated.

The above-mentioned known electron-accepting compound is preferably a phenolic compound or a salicylic acid derivative or a polyhydric metal salt thereof since they can be used by suitable selection and specifically, they suppress background fogging.

The phenolic compound includes, for example, 2,2'-bis(4-hydroxyphenol)propane (bisphenol A), 4-t-butylphenol, 4-phenylphenol, 4-hydroxydiphenoxide, 1,1'-bis(4-hydroxyphenyl)cyclohexane, 1,1' bis(3-chloro-4-hydroxyphenyl)cyclohexane, 1,1'-bis(3-chloro-4-hydroxyphenyl)-2-ethylbutane, 4,4'-sec-isoctylidenediphenol, 4,4'-sec-butylidenediphenol, 4-tert-octylphenol, 4-p-methylphenylphenol, 4,4'-methylcyclohexylidenephenol, 4,4'-isopentylidenephenol, 4-hydroxy-4 isopropyloxydiphenylsulfone, p-hydroxybenzylbenzoate, etc.

The salicylic acid derivative includes, for example, 4-pentadecylsalicylic acid, 3,5-di-(α-methylbenzyl)salicylic acid, 3,5-di-(tert-octyl)salicylic acid, 5-octadecylsalicylic acid, 5-α-(p-α-methylbenzylphenyl)ethylsalicylic acid, 3-α-methylbenzyl-5-tert-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, etc., and a zinc salt, an aluminum salt, a calcium salt, a copper salt or a lead salt thereof, etc.

When the above-mentioned known electron-accepting compound is used in combination, the content of the electron-accepting compound represented by the General formula (1) is preferably not less than 50% by mass, and specifically preferably not less than 70% by mass relative to the total mass of the electron-accepting compound.

During the preparation of the coating solution for forming the heat-sensitive recording layer, the particle size (volume mean diameter) of the electron-accepting compound is preferably not more than 1.0 μm, and more preferably 0.4–0.7 μm. When the volume mean diameter exceeds 1.0 μm, heat sensitivity sometimes decreases. When the volume mean diameter is less than 0.4 μm, background fogging sometimes deteriorates.

The volume mean diameter can be also measured readily using a laser diffraction type size distribution measuring instrument (e.g., LA500 manufactured by Horiba, Inc.), etc.

-Sensitizer-

The heat-sensitive recording layer used for the invention preferably includes a sensitizer. Specifically, in view of capacity of further improvement of sensitivity, the layer preferably includes at least one kind selected from the group consisting of 2-benzyloxynaphthalene, dimethylbenzyl oxalate, m-terphenyl, ethyleneglycol tolyl ether, p-benzylbiphenyl, 1,2-diphenoxymethylbenzene, 1,2-diphenoxyethane and diphenylsulfone.

The total content of the sensitizer to be selected for the heat-sensitive recording layer is preferably 75–200 parts by mass, and more preferably 100–150 parts by mass relative to 100 parts by mass of the electron-accepting compound (preferably 4-hydroxybenzenesulfoneanilide).

When the content is in the above-mentioned range, the effect of improvement of sensitivity can be increased. Furthermore, image retention property can be improved.

Besides the sensitizer selected from the above-mentioned group, other sensitizer selected from conventionally known ones can be used in combination so long as the effects of the invention is not deteriorated.

When the above-mentioned other sensitizer is used in combination, the amount of the sensitizer selected from the above-mentioned group is preferably not less than 50% by mass, and more preferably not less than 70% by mass relative to the total amount of the sensitizer included in the layer.

The above-mentioned other sensitizer includes, for example, aliphatic monoamide, aliphatic bisamide, stearylurea, di(2-methylphenoxy)ethane, di(2-methoxyphenoxy) ethane, β-naphthol(p-methylbenzyl)ether, α-naphthylbenzylether, 1,4-butanediol-p-methylphenylether, 1,4-butanediol-pisopropylphenylether, 1,4-butanediol-p-tert-octylphenylether, 1-phenoxy-2-(4-ethylphenoxy)ethane, 1-phenoxy-2-(chlorophenoxy)ethane, 1,4-butanediolphenylether, diethyleneglycolbis(4-methoxyphenyl)ether, 1,4-bis(phenoxymethyl)benzene, etc.

-Image Stabilizer (Ultraviolet Light Absorber)-

The heat-sensitive recording layer used for the invention preferably comprises an image stabilizer (inclusive of an ultraviolet light absorber). The ultraviolet light absorber may be incorporated in microcapsules. By incorporating the image stabilizer in the heat sensitive recording layer, the occurrence of reverse reaction to the color developing reaction (forward reaction) is inhibited and the storage property of the developed image (image retention property, heat resistance and moisture resistance) can be further improved, along with lightfastness.

As the above-mentioned image stabilizer, for example, a phenol compound, specifically a hindered phenol compound is effective, and which includes, for example, 1,1,3-tris(2-methyl-4-hydroxy-5-tert-butylphenyl)butane, 1,1,3-tris(2-methyl-4-hydroxy-5-cyclohexylphenyl)butane, 1,1,3-tris(2-ethyl-4-hydroxy-5-cyclohexylphenyl)butane, 1,1,3-tris(3,5-di-tert-butyl-4-hydroxyphenyl)butane, 1,1,3-tris(2-methyl-4-hydroxy-5-tert-butylphenyl)propane, 2,2'-methylenebis(6-tert-butyl-4-methylphenol), 2,2'-methylenebis(6-tert-butyl-4-ethylphenol), 4,4'-butylidenebis(6-tert-butyl-3-methylphenol), 4,4'-thiobis(3-methyl-6-tert-butylphenol), etc. These image stabilizers can be used solely or in combination of two or more kinds.

Among these, 1,1,3-tris(2-methyl-4-hydroxy-5-tert-butylphenyl)butane and 1,1,3-tris(2-methyl-4-hydroxy-5-cyclohexylphenyl)butane are specifically preferred.

The total content of the image stabilizer in a single heat-sensitive recording layer is preferably 10–100 parts by mass, and more preferably 20–60 parts by mass in view of suppression of background fogging and effective improvement of image retention property, heat resistance and moisture resistance.

Alternatively, when the above-mentioned image stabilizer other than these image stabilizers is used in combination of 1,1,3-tris(2-methyl-4-hydroxy-5-tert-butylphenyl)butane and/or 1,1,3-tris(2-methyl-4-hydroxy-5-cyclohexylphenyl) butane, the content of 1,1,3-tris(2-methyl-4-hydroxy-5-tert-butylphenyl)butane and/or 1,1,3-tris(2-methyl-4-hydroxy-5-cyclohexylphenyl)butane in a single heat-sensitive recording layer is preferably 50% by mass, and more preferably 70% by mass relative to the total mass of the image stabilizer.

The ultraviolet light absorber can include the ultraviolet light absorbers as shown below.

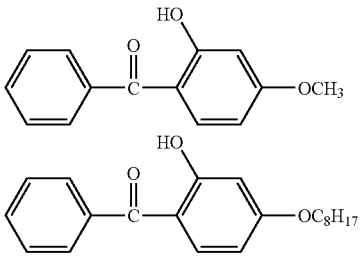

-continued

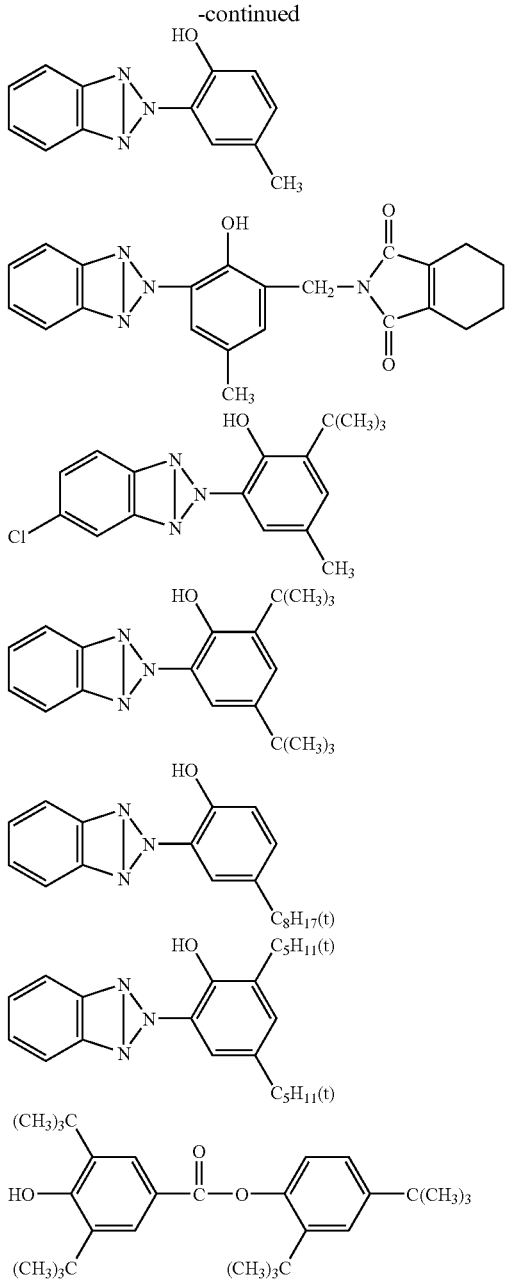

The content of the ultraviolet light absorber in a single heat-sensitive recording layer is preferably 10–300 parts by mass, more preferably 30–200 parts by mass relative to 100 parts by mass of the electron-donating colorless dye for the purpose of effective improvement of the image retention property.

-Inorganic Pigment-

The heat-sensitive recording layer used for the invention preferably comprises, as an inorganic pigment, specifically at least one kind selected from calcite calcium carbonate, amorphous silica and aluminum hydroxide (inorganic pigments used for the invention). By incorporating the inorganic pigment, head matching property with the thermal head to which the layer contacts can be improved. At the same time, stamping applicability, printing applicability and plain paper-like property can be provided.

(Light) calcium carbonate is generally in crystalline form such as calcite, aragonite, baterite, etc. Among these, calcite (light) calcium carbonate is preferred in view of prevention of color development density and head contamination after recording by a thermal head and in view of absorbing property, hardness, etc. Among these, those having particle shape of spindle-shaped and scalenohedron-surface are specifically preferred. The calcite (light) calcium carbonate can be prepared by a conventional preparation method.

The average particle size (volume mean diameter) of the calcite (light) calcium carbonate is preferably 1–3 μm. The volume mean diameter can be measured according to a similar manner to those for the above-mentioned electron-donating colorless dye, etc.

The content of the "inorganic pigment used for the invention" in a single heat-sensitive recording layer is preferably 50–500 parts by mass, more preferably 70–350 parts by mass, and specifically preferably 90–250 parts by mass relative to 100 parts by mass of the electron-accepting compound in view of improvement of color development density and prevention of adhesion of residues to a thermal head.

Furthermore, other inorganic pigment can be used in combination with the above-mentioned inorganic pigment used for the invention to the extent that the effects of the invention (specifically improvement of head matching property, printing applicability and plain paper-like property) are not deteriorated.

The above-mentioned other inorganic pigment includes calcium carbonates other than calcite (light) calcium carbonate, barium sulfate, lithpone, talc, kaolin, calcined kaolin, magnesium carbonate, magnesium oxide, etc.

The volume mean diameter of the other inorganic pigment measured by a laser diffraction type size distribution measuring instrument (e.g., LA500 manufactured by Horiba, Inc., etc.) is preferably 0.3–1.5 μm, and more preferably 0.5–0.9 μm.

When the inorganic pigment used for the invention is used in combination with the other inorganic pigment, the ratio of the total mass (V) of the "inorganic pigment used for the invention" and the total mass (W) of the other inorganic pigment (V/W) is preferably 100/0-60/40, and more preferably 100/0-80/20.

Furthermore, an inorganic pigment having Mohs hardness of not more than 3 is preferred in view of suppression of abrasion of a thermal head. The "Mohs hardness" means Mohs hardness described in "English-Japanese Plastic Industrial Dictionary $5^{th}$ issue p. 616" (Shin Ogawa, Kogyo Chosakai Publishing Co., Ltd.). The inorganic pigment having Mohs hardness of not more than 3 includes calcium carbonate, aluminum hydroxide, etc.

Use of the inorganic pigment used for the invention as a mixture with magnesium carbonate and/or magnesium oxide is preferable since it is effective for suppression of background fogging. The content of magnesium carbonate and/or magnesium oxide is preferably 3–50% by mass, and specifically 5–30% by mass of relative to the total mass of the organic pigment.

-Adhesive-

The heat-sensitive recording layer used for the invention preferably comprises at least one kind selected from sulfo-modified polyvinyl alcohol, diacetone-modified polyvinyl alcohol and acetoacetyl-modified polyvinyl alcohol (i.e., modified polyvinyl alcohols (hereinafter sometimes referred to as "specific modified PVA") as an adhesive (or a protective colloid for dispersion). By incorporating the specific modified PVA in the heat-sensitive recording layer as an adhesive, plain paper-like feeling can be provided, and adhesive force between the heat-sensitive recording layer and the substrate can be increased to prevent troubles such as peeling of paper that occurs during offset printing, etc., which can lead to improvement of printing applicability. Furthermore, color development density when recorded with a thermal head can be increased while suppressing background fogging during recording, which can lead compatibility between improvement of sensitivity to high level and further decrease of background fogging.

The above-mentioned specific modified PVAs can be used solely or in combination, or in combination with other modified PVA or polyvinyl alcohol (PVA).

When the above-mentioned other modified PVA or PVA is used in combination, the ratio of the above-mentioned specific modified PVA is preferably not less than 10% by mass, and more preferably not less than 20% by mass relative to the total mass of the adhesive component.

The above-mentioned specific modified PVA is preferably one having a saponification degree of 85–99% by mole.

When the above-mentioned saponification degree is less than 85% by mole, the water resistance against wetting water to be used during offset printing becomes insufficient, which sometimes results in so-called peeling of paper. On the other hand, when the amount of the modified PVA to be added is increased aiming at avoiding such peeling of paper, color development density sometimes decreases. Furthermore, when the above-mentioned saponification degree exceeds 99% by mole, unsolved products are easily produced during the preparation of a coating solution, which sometimes results in bad coating property.

For the purpose of avoiding deterioration of the effect of the invention, when the other modified PVA and/or PVA is(are) used in combination, the saponification degree(s) of the other modified PVA and/or PVA is(are) preferably in the above-mentioned range.

Specifically, the polymerization degree of the above-mentioned specific modified PVA is preferably 200–2,000.

When the above-mentioned polymerization degree is less than 200, peeling of paper easily occurs during offset printing. Furthermore, when the amount to be added is increased aiming at avoiding peeling of paper, color development density sometimes decreases. Furthermore, when the above-mentioned polymerization degree exceeds 2000, the modified PVA becomes hardly-soluble in a solvent (water), and the viscosity of liquid during preparation increases, which makes preparation of a coating solution for forming a heat-sensitive recording layer and the application thereof difficult.

For the purpose of avoiding deterioration of the effect of the invention, when the other modified PVA and/or PVA is(are) used in combination, the polymerization degree(s) of the other modified PVA and/or PVA is(are) preferably in the above-mentioned range.

The polymerization degree as used herein refers to the average polymerization degree obtained by the method described in JIS-K6726 (1994).

The content of the specific modified PVA in the heat-sensitive recording layer is preferably 30–300 parts by mass, more preferably 70–200 parts by mass, and specifically preferably 100–170 parts by mass relative to 100 parts by mass of the electron-donating colorless dye in view of improvement of color development density and provision of offset printing applicability (prevention of peeling of paper, etc.).

The above-mentioned specific modified PVA functions not only as an adhesive for increasing adhesive force between the layers but also as a dispersing agent, a binder, etc.

Secondly, each of the specific modified PVAs, i.e., sulfo-modified polyvinyl alcohol, diacetone-modified polyvinyl alcohol and acetoacetyl-modified polyvinyl alcohol are specifically explained.

The above-mentioned sulfo-modified polyvinyl alcohol can be prepared by a method comprising copolymerizing an olefinsulfonic acid or a salt thereof such as ethylenesulfonic acid, allylsulfonic acid, methallylsulfonic acid, etc. with a vinylester such as vinyl acetate, etc. in an alcohol or a mixed solvent of an alcohol and water to give a polymer and saponifying the obtained polymer; a method comprising copolymerizing an amide sodium salt and a vinyl ester such as vinyl acetate, etc. and saponifying the obtained polymer; a method comprising treating PVA with bromine, iodine, etc. and heating the treated PVA in an acidic aqueous sodium sulfite solution; a method comprising heating PVA in a concentrated aqueous sulfuric acid solution, or a method comprising acetalating PVA with an aldehyde compound comprising a sulfonic acid group, etc.

The above-mentioned diacetone-modified polyvinyl alcohol is a partial or complete saponified product of a copolymer of a monomer having diacetone group and a vinyl ester, which can be prepared by a method comprising copolymerizing a monomer having diacetone group and a vinyl ester to give a resin and saponifying the obtained resin.

The ratio of the monomer having diacetone group in the above-mentioned diacetone-modified polyvinyl alcohol (repeating unit structure) is not specifically limited.

The above-mentioned acetoacetyl-modified polyvinyl alcohol can be generally prepared by adding liquid or gaseous diketene to a solution, a dispersion or powder of a polyvinyl alcohol resin to react the diketene with the resin. The acetylation degree of the acetoacetyl-modified polyvinyl alcohol can be suitably selected according to the desired quality of the objective heat-sensitive recording material.

-Other Components-

The heat-sensitive recording layer used for the invention may include, according to the purpose and need, other components such as a cross-linking agent, other pigment, a metal soap, wax, a surfactant, a binder, an antistatic agent, a defoaming agent, a fluorescence dye, etc. besides the above-mentioned components.

[Cross-linking Agent]

The heat-sensitive recording layer may include a cross-linking agent that reacts with the above-mentioned specific modified PVA used as an adhesive (or a protective colloid) and other modified PVA, etc. By incorporating such cross-linking agent, water resistance of the heat-sensitive recording material can be improved.

The above-mentioned cross-linking agent can be suitably selected from cross-linking agents those can cross-link a specific modified PVA (and preferably the above-mentioned other modified PVA, etc.). Among these, aldehyde compounds such as glyoxal, etc., dihydrazide compounds such as adipic acid dihydrazide, etc. are specifically preferred.

The content of the cross-linking agent in the heat-sensitive recording layer is preferably 1–50 parts by mass, and more preferably 3–20 parts by mass relative to 100 parts by mass of the specific modified PVA or other modified PVA, etc., to be-cross-linked. When the content of the cross-inking agent is in the above-mentioned range, water resistance can be improved effectively.

[Dye Mordant]

The heat-sensitive recording layer may include a dye mordant for the purpose of preventing blotting after ink jet recording.

The above-mentioned dye mordant includes a compound having at least one kind of cation group selected from an amide group, an imide group, a primary amino group, a secondary amino group, a tertiary amino group, a primary ammonium salt group, a secondary ammonium salt group, a tertiary ammonium salt group and a quatenary ammonium salt group.

Specific examples thereof include polyamide epichlorohydrin, polyvinylbenzyltrimethylammonium chloride, polydiallyldimethylammonium chloride, polymethacryloyloxyethyl-□-hydroxyethyldimethylammonium chloride, polydimethylaminoethylmethacrylate hydrochloride, polyethyleneimine, polyallylamine, polyallylamine hydrochloride, polyamide-polyamine resin, cationated starch, dicyanodiamide-formalin condensate, dimethyl-2-hydroxypropylammonium salt polymer, etc.

Besides the above-mentioned polymers, cationic polymers are also preferred. Such cationic polymer includes, for example, polyethyleneimine, polydiallylamine, polyallylamine, polydiallyldimethylammonium chloride, polymethacryloyloxyethyl-□-hydroxyethyldimethylammonium chloride, polyallylamine hydrochloride, polyamide-polyamine resin, cationated starch, dicyanodiamide formalin condensate, dimethyl-2-hydroxypropylammonium salt polymer, polyamidine, polyvinylamine, etc.

The molecular weight of the above-mentioned dye mordant is preferably about 1000–200000. When the molecular weight is less than 1000, water resistance tends to become insufficient, and when the molecular weight exceeds 200000, viscosity increases, which sometimes leads to bad handling applicability.

The above-mentioned cationic polymer may be added to either the heat-sensitive recording layer or the protective layer mentioned below.

[Metal Soap, Wax and Surfactant]

The metal soap includes a higher fatty acid metal salt, specifically zinc stearate, calcium stearate, stearate aluminum, etc.

The wax includes such as paraffin wax, microcrystalline wax, carnauba wax, methylolstearoamide, polyethylene wax, polystyrene wax and fatty acid amide wax, etc. These can be used solely or in combination of two or more kinds.

The surfactant includes such as a sulfosuccinic acid alkali metal salt, fluorine-containing surfactant, etc.

[Binder]

The above-mentioned electron-donating colorless dye, electron-accepting compound, inorganic pigment, adhesive and sensitizer, and the other components can be suitably dispersed in a water soluble binder. The binder as used herein is preferably a compound that can dissolve by not less than 5% by mass in 25° C. water. The binder specifically includes such as polyvinyl alcohol, methylcellulose, carboxymethylcellulose, starchs (inclusive of modified starchs), gelatin, gum arabic, casein, a saponified product of styrene-maleic anhydride copolymer, etc.

The above-mentioned binder not only functions to improve film strength during dispersion but also functions to improve film strength of the heat-sensitive recording layer. For exhibiting such function, synthetic polymer latex binders such as styrene-butadiene copolymer, vinyl acetate copolymer, acrylonitrile-butadiene copolymer, methyl acrylate-butadiene copolymer, polyvinylidene chloride, etc. can be used in combination.

-Others-

The above-mentioned electron-donating colorless dye, electron-accepting compound, inorganic pigment, adhesive and sensitizer can be formed into a coating solution by simultaneously or separately dispersing them using a stirrer with a crusher such as a ball mill, an attriter, a sand mill, etc. If necessary, the above-mentioned other components, i.e., a cross-linking agent, a dye mordant, a metal soap, wax, a surfactant, a binder, an antistatic agent, a defoaming agent, and a fluorescence dye, etc. are added to the coating solution.

The coating solution is prepared as above and applied on a surface of a substrate, whereby a heat-sensitive recording layer is formed. The coating method for coating the coating solution utilizes a curtain coater, and the coated layer is dried after coating. After drying, the coated layer is preferably smooth processed by calendar processing for use.

The dried coating amount of the coating solution for applying and forming a heat-sensitive recording layer is not specifically limited, but is preferably less than 6 $g/m^2$, more preferably not more than 5 $g/m^2$, and specifically preferably not more than 4 $g/m^2$.

<Protective Layer>

The heat-sensitive recording layer preferably comprises at least one protective layer thereon. The protective layer may include organic or inorganic micropowder, a binder, a surfactant, a thermoplastic substance, etc.

The above-mentioned micropowder includes, for example, inorganic micropowder such as calcium carbonate, silicas, zinc oxide, titanium oxide, aluminum hydroxide, zinc hydroxide, barium sulfate, kaolin, clay, talc, surface-treated calcium or silica, etc., organic micropowder such as urea-formalin resin, styrene/methacrylic acid copolymer, polystyrene, etc.

The binder to be included in the protective layer can include, for example, polyvinyl alcohol, carboxy-modified polyvinyl alcohol, vinyl acetate-acrylamide copolymer, silicon-modified polyvinylalcohol, starch, modified starch, methylcellulose, carboxymethylcellulose, hydroxymethylcellulose, gelatins, gum arabic, casein, styrene-maleic acid copolymer hydrolysate, polyacrylamide derivative and polyvinylpyrrolidone, and latexes such as styrene-butadiene rubber latex, acrylonitrile-butadiene rubber latex, methyl acrylate butadiene rubber latex, vinyl acetate emulsion, etc.

Alternatively, an embodiment wherein a waterproof agent for cross-linking a binder component in a protective layer is added to a protective layer so as to further improve storage and stabilization property of a heat-sensitive recording material is also preferred. The waterproof agent includes, for example, water soluble initial condensates such as N-methylolurea, N-methylolmelamine, urea-formalin, etc., dialdehyde compounds such as glyoxal, glutalaldehyde, etc., inorganic cross-linking agents such as boric acid, boric sand, colloidal silica, etc., polyamide epichlorohydrin, etc.

Among these, specifically preferable protective layer is an embodiment comprising at least one inorganic pigment selected from aluminum hydroxide, kaolin and amorphous silica and a water soluble polymer. By constituting such embodiment, storage property can be improved due to oil-absorbing property of the inorganic pigment, etc., and handling property and stamping applicability (plain paper-like feeling) can be also provided. In addition, the embodiment may also include a surfactant, a thermoplastic substance, etc.

The volume mean diameter of the inorganic pigment to be included in a protective layer is preferably 0.5–3 μm, and more preferably 0.7–2.5 μm. Specifically, aluminum hydroxide having the volume mean diameter of 0.5–1.2 μm is preferred in view of improvement of stamping applicability, and amorphous silica is preferred in view of improvement of ink jet applicability. The volume mean diameter can be measured according to a similar manner to that for the above-mentioned electron-donating colorless dye, etc.

The total content of the inorganic pigment selected from aluminum hydroxide, kaolin and amorphous silica is preferably 10–90% by mass, and more preferably 30–70% by mass relative to the total solid content of the coating solution for forming a protective layer. Furthermore, other pigments such as barium sulfate, zinc sulfate, talc, clay, colloidal silica, etc. can be used in combination so long as the effects of the invention (specifically improvement of storage property, and provision of handling property and stamping applicability) are not deteriorated.

The above-mentioned water soluble polymer includes, among the above-mentioned binders, polyvinyl alcohol or modified polyvinyl alcohols (hereinafter generally referred to as "polyvinyl alcohol"), starch or modified starches such as oxidized starch, urea phosphate esterified starch, etc., carboxyl group-containing polymers such as styrene-maleic anhydride copolymer, styrene-maleic anhydride copolymer alkyl esterified product, styrene-acrylic acid copolymer, etc. Among these, polyvinyl alcohol, oxidized starch, urea phosphate esterified starch are preferred in view of stamping applicability, and a mixture of polyvinyl alcohol (x) and oxidized starch and/or urea phosphate esterified starch (y) having the mass ratio (x/y) of 90/10 to 10/90 is specifically preferred. Specifically, when the above-mentioned polyvinyl alcohol, oxidized starch and urea phosphate esterified starch are used in combination, the mass ratio ($y^1/y^2$) of oxidized starch ($y^1$) and urea phosphate esterified starch ($y^2$) is preferably 10/90 to 90/10.

The above-mentioned modified polyvinyl alcohol is preferably acetoacetyl-modified polyvinyl alcohol, diacetone-modified polyvinyl alcohol, silicon modified polyvinyl alcohol and amide-modified polyvinyl alcohol. In addition, sulfo-modified polyvinyl alcohol, carboxy-modified polyvinyl alcohol, etc. are also used.

Furthermore, use of a cross-linking agent that reacts with the polyvinylalcohol in combination can improve storage property, handling property and stamping applicability.

The ratio of the above-mentioned water soluble polymer is preferably 10–90% by mass, and more preferably 30–70% by mass relative to the total solid content (mass) of the coating solution for forming a protective layer.

The cross-inking agent for cross-inking the above-mentioned water soluble polymer preferably includes, polyhydric amine compounds such as ethylenediamine, etc., polyhydric aldehyde compounds such as glyoxal, glutalaldehyde, dialdehyde, etc., dihydrazide compounds such as adipic acid dihydrazide, phthalic acid dihydrazide, etc., water soluble methylol compounds (urea, melamine and phenol), multifunctional epoxy compounds, polyhydric metal salts (Al, Ti, Zr, Mg, etc.), etc. Among these, polyhydric aldehyde compounds, di-hydrazide compounds are preferred.

The content ratio of the above-mentioned cross-linking agent is preferably about 2–30% by mass, and more preferably 5–20% by mass relative to the mass of the above-mentioned water soluble polymer. By incorporating the cross-inking agent, film strength, water resistance, etc. can be further improved.

The mixing ratio of the inorganic pigment selected from aluminum hydroxide, kaolin and amorphous silica and the water soluble polymer in the protective layer is, although it varies depending on the kind and the particle size of the inorganic pigment, kind of the water soluble polymer, etc., preferably 50–400% by mass, and more preferably 100–250% by mass of the amount of the water soluble polymer relative to the mass of the inorganic pigment.

The total mass of the inorganic pigment and the water soluble polymer in the protective layer is preferably not less than 50% by mass of the total solid content mass of the protective layer.

Alternatively, in view of improvement of ink jet ink applicability, an embodiment in which a surfactant is added to the above-mentioned protective layer, i.e., to a coating solution for forming a protective layer (hereinafter sometimes referred to as "coating solution for a protective layer") is also preferred.

The above-mentioned surfactant preferably includes alkylbenzenesulfonic acid salts such as sodium dodecylbenzenesulfonate, etc., sulfosuccinic acid alkyl ester salts such as sodium dioctylsulfosuccinate, etc., polyoxyethylenealkyletherphosphate ester, sodium hexametaphosphate, perfluoroalkylcarboxylate, etc. Among these, sulfosuccinic acid alkyl ester salt is more preferred.

The content ratio of the above-mentioned surfactant is preferably 0.1–5% by mass, and more preferably 0.5–3% by mass relative to the total solid content (mass) of the coating solution for forming a protective layer.

The coating solution for a protective layer can be prepared by dissolving or dispersing the above-mentioned inorganic pigment selected from aluminum hydroxide, kaolin and amorphous silica and water soluble polymer, and if required, a cross-linking agent, a surfactant, etc. in a desired aqueous solvent. The coating solution may include a lubricant, a defoaming agent, a fluorescent brightening agent, a colored organic pigment, etc. so long as the effects of the invention (specifically improvement of storage property and provision of handling property and stamping applicability) are not deteriorated.

The above-mentioned lubricant includes, for example, metal soaps such as zinc stearate, calcium stearate, etc., waxes such as paraffin wax, microcrystalline wax, carnauba wax, synthetic polymer wax, etc.

-Substrate-

Conventionally known substrates can be applied for the above-mentioned substrate. Specifically, substrates such as paper substrates such as quality paper, etc., coated paper comprising paper and a resin or a pigment applied thereon, resin laminate paper, quality paper having a primer layer, synthetic paper, plastic film, etc. are exemplified. A substrate comprising recycled pulp as a main component, i.e. a substrate wherein 50% by mass of the substrate consists of recycled pulp, can be also used.

The above-mentioned substrate is preferably a smooth substrate having a smoothness degree in the range of 300 seconds to 500 seconds defined by JIS-8119 in view of dot reproducibility. Furthermore, for the same reason, the smoothness degree of the substrate defined by JIS-8119 is not less than 100 seconds, and more preferably not less than 150 seconds.

The above-mentioned recycled pulp is made by the combination of the following three steps 1) to 3).

1) Solution . . . treating recycled paper using a pulper to form fibers by mechanical force and a chemical agent, and peeling the ink printed on the fibers.
2) Dust cleaning . . . removing foreign substances (plastic, etc.) and dusts contained in recycled paper.
3) Deinking . . . removing the printed ink peeled from the fibers out of the system by floatation method or washing method.

If desired, bleaching can be carried out simultaneously with deinking or in another step.

Using the thus-obtained recycled pulp (100% by mass) or a mixture of recycled pulp and virgin pulp (content less than 50% by mass), a substrate for a heat-sensitive recording material conventional method is formed.

The above-mentioned substrate may comprise a primer layer. In this case, the primer layer is preferably provided on a surface of a substrate having the Stockigt size of not less than 5 seconds, and the primer layer preferably comprises a pigment and a binder as main components.

As the pigment for a primer layer, all of general inorganic or organic pigments can be used, and an oil-absorbing pigment having oil-absorbing degree defined by JIS-K5101 of not less than 40 ml/100 g (cc/100 g) is specifically preferred. Specific examples of the oil-absorbing pigment include calcined kaolin, aluminum oxide, magnesium carbonate, calcined diatomaceous earth, aluminum silicate, magnesium aluminosilicate, calcium carbonate, barium sulfate, aluminum hydroxide, kaolin, calcined kaolin, amorphous silica, urea-formalin resin powder, etc. Among these, calcined kaolin having oil-absorbing degree of 70 ml/100 g to 80 ml/100 g is specifically preferred.

The coating amount of the above-mentioned pigment during application and formation of a primer layer on a substrate is preferably not less than 2 g/m$^2$, more preferably 4 g/m$^2$, and specifically preferably 7–12 g/m$^2$.

The binder for primer layer includes water soluble polymers and aqueous binders. These may be used solely or in combination of two or more.

The above-mentioned water soluble polymer includes, for example, starch, polyvinyl alcohol, polyacrylamide, carboxymethylcellulose, methylcellulose, casein, etc. The above-mentioned aqueous binder is generally synthetic rubber latex or synthetic resine emulsion, and includes, for example, styrene-butadiene rubber latex, acrylonitrile butadiene rubber latex, methyl acrylate butadiene rubber latex, vinyl acetate emulsion, etc.

The amount of the binder for a primer layer to be used is determined in accordance with film strength, heat sensitivity of a heat-sensitive-color developing layer, etc., and is preferably 3–100% by mass, more preferably 5–50% by mass, and specifically preferably 8–15% by mass relative to the mass of the pigment in the primer layer. The primer layer may comprise wax, an antidecolorant, a surfactant, etc.

The coating solution for forming a primer layer can be applied according to a known coating method. Specific examples include coating methods using an air knife coater, a roll coater, a blade coater, a gravure coater, a curtain coater, etc. Among these, a coating method using a curtain coater or a blade coater is preferable, and a coating method using a blade coater is more preferable. After application and drying, smoothing treatment (and if necessary, calendaring), etc. may be provided to the primer layer.

The method using the above-mentioned blade coater is not limited to coating method using a bevel type blade or a pent type blade, and includes coating method using a rod blade, coating method using a pill blade, etc. Furthermore, the coating method is not limited to methods using an off-machine coater, and coating can be carried out using an on-machine coater provided on a paper pressing machine. In addition, in order to obtain superior smoothness and surface shape by providing flowability during blade coating, the coating solution for forming a primer layer (a coating solution for a undercoat layer) may comprise carboxymethylcellulose having an etheration degree of 0.6–0.8 and an weight average molecular weight of 20,000–200,000 by 1–5% by mass, preferably 1–3% by mass relative to the amount of the above-mentioned pigment.

The coating amount of the primer layer is, although it is not specifically limited, preferably not less than 2 $g/m^2$, more preferably not less than 4 $g/m^2$, and specifically preferably not less than 7–12 $g/m^2$ in accordance with the characteristic of the heat-sensitive recording material.

In the invention, primer base paper having a primer layer (specifically preferably a primer layer having high oil-absorbing property, high adiabatic effect and high planarity) is preferred, and primer base paper having a primer layer comprising an oil-absorbing pigment using a blade coater is specifically preferred in view of improvement of head matching property of a thermal head and improvement of sensitivity and image quality.

The total ion concentration of $Na^+$ ion and $K^+$ ion included in the heat-sensitive recording material is preferably not less than 1500 ppm, more preferably not less than 1000 ppm, and specifically preferably not less than 800 ppm in view of prevention of head corrosion of a thermal head contacting with the heat-sensitive recording material. As a result of selecting and using a material having low ion content, the total ion concentration relative to the total of the substrate, layer, etc. constituting the heat-sensitive recording material can be suppressed and the amount of ion adhered to the head can be suppressed, which can lead to improvement of anticorrosion property (durability) of the thermal head.

The ion concentration of the above-mentioned $Na^+$ ion and $K^+$ ion can be measured by extracting the heat-sensitive recording material with heated water and measuring the heated water for ion masses of $Na^+$ ion and $K^+$ ion by ion quantitative analysis method by atomic absorption method. The above-mentioned total ion concentration is represented by ppm relative to the total mass of the heat-sensitive recording material.

For the heat-sensitive recording material of the invention, wettness of the surface of the heat-sensitive recording layer, i.e., the contact angle of the droplet of distilled water dropped on the surface of the heat-sensitive recording layer after 0.1 second is preferably not less than 20°, and more preferably 50° or more. By adjusting the above-mentioned contact angle to the above-mentioned range, blotting of ink after printing using an ink jet printer or after stamping can be prevented effectively (provision or improvement of ink jet applicability), by which improvement of stamping applicability can be achieved.

The above-mentioned contact angle can be obtained by incorporating an electron-accepting compound represented by the General formula (1) (preferably 4-hydroxybenzenesulfonanilide). Alternatively, a method comprising adding materials capable of maintaining the contact angle of distilled water on the recording surface, such as a sensitizer, paraffin wax used for the invention, to the heat-sensitive recording layer is also preferable.

The above-mentioned contact angle can be measured by dropping distilled water on the surface (recording surface) of the heat-sensitive recording layer of the sensitive recording material and measuring the contact angle after 0.1 seconds by a conventional method, for example, using a dynamic contact angle absorption tester such as FIBRO system (trade name: DAT1100, manufactured by FIBRO system, ab).

The heat-sensitive recording material of the invention is useful in view of superior image retention property, and the density retention rate of the above-mentioned formed image after standing the photographic printed formed image under the environment condition of temperature of 60° C. and relative humidity of 20% for 24 hr is preferably not less than 65%. As mentioned above, by incorporating the electron-accepting compound represented by the General formula (1) (specifically preferably 4-hydroxybenzenesulfoneanilide), preferably an image stabilizer, etc., the above-mentioned density retention rate can be adjusted in the above-mentioned range. Accordingly, the formed image can be maintained at high density for a long period, and can be applied to the field in which image reliability is required for a long period such as storage of important documents, advance tickets, receipts, cash vouchers, etc.

The density retention rate of the image is represented, as shown in the following equation, by the ratio (%) of the density of an image after standing under the atmosphere of temperature of 60° C. and relative humidity of 20% for 24 hours after photographic printing, relative to the image density measured using Macbeth reflection densitometer (e.g., RD-918) immediately after photographic printing of the image, wherein both printing are conducted under the same condition.

Density retention rate=[(Image density after standing)/(Image density immediately after printing)]×100

The heat sensitive recording material of the invention is produced by applying the heat sensitive recording layer by curtain coating followed by drying. The heat sensitive recording materials according to the first, second, ninth, thirteenth and seventeenth aspects of the invention are preferably produced by forming a single or a plurality of layers by applying one or a plurality of coating solutions on a surface of the substrate by curtain coating, followed by drying the coating layers. The layers formed by curtain coating are not restricted to the heat sensitive recording layer, and contain an undercoat layer and a protective layer (these layers are collectively named as "coating layers"). These adjacent layers may be simultaneously applied by curtain coating. At least one layer is formed by curtain coating using a curtain coater in the invention, since a higher density (higher sensitivity) may be obtained by using a smaller amount of materials while improving image quality. Simultaneously coated multi-layers by curtain coating permit reduction in energy consumption during a production process and allow production of the heat sensitive recording material with providing a reduced environmental burden.

Examples of the combination of the layers formed by simultaneously applying the multi-layers include a combination of the undercoat layer and the heat sensitive recording layer, a combination of the heat sensitive recording layer and the protective layer, a combination of the undercoat layer, the heat sensitive recording layer and the protective layer, a combination of at least two kinds of different heat sensitive recording layers, and a combination of at least two kinds of different protective layers. However, the combination is not particularly limited thereto.

Examples of the curtain coater used for applying the coating solution on the substrate include an extrusion hopper curtain coater and a slide hopper curtain coater. While the coater is not particularly restricted, the slide hopper type curtain coater used for photographic photosensitive materials as disclosed in Japanese Patent Application Publication (JP-B) No. 49-24133 may be preferably used. Multilayers may be readily and simultaneously formed using the slide hopper type curtain coater.

The viscosity of the coating solution for forming the coating layer is specified within 30 to 300 mPa·s in the heat sensitive recording material according to the second aspect of the invention. Incidences of defected coating may be reduced while improving the surface state of the coating layer by adjusting the viscosity within the above-described range. The surface state of the coating layer becomes poor when the viscosity is less than 30 mPa·s, while easily providing troubles on the coating layer since defoaming becomes difficult when the viscosity exceeds 300 mPa·s. The viscosity as used herein is a viscosity of the coating solution measured at 60 rpm using a B-type viscometer at a coating temperature.

The viscosity of the coating solution preferably ranges from 30 to 250 mPa·s, and more preferably 50 to 200 mPa·s.

It is effective for adjusting the viscosity of the coating solution at a desired value to add a water-soluble polymer having a high viscosity. Specifically, sodium carboxymethyl cellulose having a high molecular weight is most preferable since it does not adversely affect sensitivity.

The surface tension of the coating solution is preferably 25 to 50 mN/m in the heat sensitive recording material according to the second aspect of the invention. A stable curtain film may be formed while improving the surface state of the coating layer when the surface tension of the coating solution falls within the range of 25 to 50 mN/m. Thus, a good surface state of the coating layer can be obtained. The surface tension as used herein refers to a so-called static surface tension of the coating solution measured by a platinum plating method at a coating temperature.

While it is effective to add a surfactant for adjusting the surface tension of the coating solution, alkylbenzene sulfonate, alkylnaphthalene sulfonate, sulfosuccinate alkyl ester and polyoxyethylene alkylether phosphate ester are preferable, since fogging scarcely occurs and sensitivity is hardly reduced. Sodium dodecylbenzene sulfonate, triethanolamine salt of dodecylbenzene sulfonate, sodium salt of sulfosuccinate 4-methylpentyl ester, sodium salt of sulfosuccinate 2-ethylhexyl ester, and sodium salt of polyoxyethylene alkylether phosphate ester are particularly preferable among them.

According to the ninth aspect of the heat sensitive recording material of the invention, the highest surface temperature of the heat sensitive recording layer is maintained at 65° C. or lower during the constant rate drying process. The temperature of 65° C. or lower makes it possible to obtain the heat sensitive recording material having high whiteness. Whiteness is lowered if the temperature exceeds 65° C., even temporarily, during the constant rate drying process. The temperature is preferably 55° C. or lower, and more preferably 45° C. or lower.

The constant rate drying process as used herein refers to a duration of a phenomenon in which a moisture content in the coating layer decreases in proportion to the time.

According to the thirteenth aspect of the heat sensitive recording material of the invention, the coating speed of the curtain coating is adjusted to 200 to 2,000 m/minute with specifying a falling speed of the coating solution in the form of a film at the coating point of 1/40 to 1 time of the coating speed, which allows reduced incidences of defected coating and improves the surface state of the coating layer. The coating speed as used herein refers to a running speed of the substrate to which curtain coating is applied, and the coating point refers to the point where the coating solution in the form of a film falls down. The falling speed refers to the speed at the point where the coating solution in the form of a film drops at the coating point.

The falling speed is more preferably 1/20 to 1/2 time, and more preferably 1/15 to 1/3 time of the coating speed. The curtain film may be deteriorated or the coating solution in the form of a film cannot be uniformly spread by the action of air accompanying the substrate when the falling speed is less than 1/40 time of the coating speed, thus resulting in a poor surface state of the coating layer. When the falling speed exceeds 1 time of the coating speed, on the other hand, a "liquid pool" is formed at a side that is upstream of the coating point, leading to another poor surface state of the coating layer.

The falling speed may be controlled by changing an initial falling position of the coating solution relative to a position of a curtain coating head (a height from the falling point), or by changing an ejecting speed of the coating solution. The falling position is usually adjusted in the range of 10 to 300 mm by considering handling ability and stability of the curtain film.

The central line average roughness ($R_{a75}$) at a surface of the heat sensitive recording layer is adjusted to be not more than 2.0 μm in the heat sensitive recording material according to the seventeenth aspect of the invention. The central line average roughness ($R_{a75}$) at the surface of the heat sensitive recording layer is preferably 0.5 to 2.0 μm. The central line average roughness ($R_{a75}$) at the surface of the heat sensitive recording layer may be measured according to the method standardized in JIS B 0601 (1994).

The image density is preferably no less than 1.20 when thermal printing at an applied energy of 15.2 mJ/mm$^2$ onto the heat sensitive recording material according to the fifth aspect of the invention. Each component constitution, layer construction and application method, particularly the kind and the amount of the electron-donating colorless dye, the electron-accepting compound, the adhesive and the sensitizer, and the coating method and the protective layer may be selected depending on a preferable embodiment to obtain image density of 1.20 or more.

Ii is particularly preferable that image density at the applied energy falls within a range of 1.25 to 1.35.

EXAMPLES

Hereinafter the invention is explained with referring the Examples. However, the invention should not be construed to be limited to these Examples. As used herein, the "parts" and "%" in Examples each means "parts by mass" and "% by mass", respectively.

Example 1

Preparation of a Coating Solution for a Heat-sensitive Recording Layer

-Preparation of Dispersion A (Containing an Electron-donating Colorless Dye)-

The following components were dispersed and mixed in a ball mill to give Dispersion A having the volume mean diameter of 0.7 μm. The volume mean diameter was measured using a laser diffraction type size distribution measuring instrument (trade name: LA500, manufactured by Horiba, Inc.).

| [Composition of Dispersion A] | |
|---|---|
| 2-Anilino-3-methyl-6-diethylaminofluorane (an electron-donating colorless dye) | 10 parts |
| Polyvinyl alcohol 2.5% solution (trade name: PVA-105, manufactured by Kuraray Co., Ltd.) | 50 parts |

-Preparation of Dispersion B (Containing an Electron-accepting Compound)-

The following components were dispersed and mixed in a ball mill to give Dispersion B having the volume mean diameter of 0.7 μm. The volume mean diameter was measured according to a similar manner to that for Dispersion A.

| (Composition of Dispersion B) | |
|---|---|
| 4-Hydroxybenzenesulfoneanilide (an electron-accepting compound represented by the General formula (1)) | 20 parts |
| Polyvinyl alcohol 2.5% solution (trade name: PVA-105, manufactured by Kuraray Co., Ltd.) | 100 parts |

-Preparation of Dispersion C (Containing a Sensitizer)-

The following components were dispersed and mixed in a ball mill to give Dispersion C having the volume mean diameter of 0.7 μm. The volume mean diameter was measured according to a similar manner to that for Dispersion A.

| (Composition of Dispersion C) | |
|---|---|
| 2-Benzyloxynaphthalene (a sensitizer) | 20 parts |
| Polyvinyl alcohol 2.5% solution (trade name: PVA-105, manufactured by Kuraray Co., Ltd.) | 100 parts |

-Preparation of Dispersion D (Containing a Pigment)-

The following components were dispersed and mixed in a sand mill to give Dispersion D having the volume mean diameter of 2.0 μm. The volume mean diameter was measured according to a similar manner to that for Dispersion A.

| (Composition of Dispersion D) | |
|---|---|
| Calcite light calcium carbonate (trade name: UNIVER 70, manufactured by Shiraishi Kogyo K.K.) | 40 parts |
| Sodium polyacrylate | 1 parts |
| Distilled Water | 60 parts |

-Preparation of a Coating Solution for a Heat-sensitive Recording Layer-

The following components were mixed to give a coating solution for a heat-sensitive recording layer.

| (Composition of a coating solution for a heat recording layer) | |
|---|---|
| Dispersion A | 60 parts |
| Dispersion B | 120 parts |
| Dispersion C | 120 parts |
| Dispersion D | 101 parts |
| Zinc stearate 30% Dispersion | 15 parts |
| Paraffin wax (30%) | 15 parts |
| Sodium carboxymethylcellulose (1% aqueous solution of Cellogen EP (manufactured by Daiichi Kogyo Seiyaku Co., Ltd.)) | 100 parts |
| Sodium dodecylbenzenesulfonate (25%) | 4 Parts |

Preparation of a Coating Solution for a Substrate Undercoat Layer

The following components were mixed by stirring using a dissolver to give a Dispersion.

| | |
|---|---|
| Calcined kaolin (oil-absorption amount 75 ml/100 g) | 100 parts |
| Sodium hexametaphosphate | 1 part |
| Distilled water | 110 parts |

To the obtained Dispersion were then added SBR (styrene-butadiene rubber latex, 20 parts) and an oxidized starch (25%, 25 parts) to give a coating solution for a substrate undercoat layer.

Preparation of a Heat-sensitive Recording Material

Quality paper having a smoothness degree measured by JIS-8119 of 150 seconds was prepared as a substrate. To the surface of the quality paper was applied the coating solution for a substrate undercoat layer obtained as above by a blade coater so that the coating amount after drying became 8 g/m$^2$ to give an undercoat layer. By applying the undercoat layer, the smoothness degree measured by JIS-8119 of the substrate became 350 seconds.

On the undercoat layer was then applied the coating solution for a heat-sensitive recording layer as obtained above using a curtain coater so that the coating amount after drying became 4 g/m$^2$ and dried to form a heat-sensitive recording layer. To the surface of the thus-formed heat-sensitive recording layer was then calendared to give the heat-sensitive recording material (1) of the invention.

Example 2

Preparation of Dispersion E

The following components were dispersed and mixed in a sand mill to give Dispersion E having the volume mean diameter of 0.7 μm. The volume mean diameter was measured according to a similar manner to Example 1.

| (Composition of Dispersion E) | |
|---|---|
| 1,1,3-Tris(2-methyl-4-hydroxy-5-tert-butylphenyl)-butane (an image stabilizer) | 5 parts |

-continued

| (Composition of Dispersion E) | |
|---|---|
| Polyvinyl alcohol 2.5% solution (Trade name: PVA-105, manufactured by Kuraray Co., Ltd.; an adhesive) | 25 parts |

Preparation of a Coating Solution for a Heat-Sensitive Recording Layer

Dispersions A, B, C and D were prepared according to a similar manner to Example 1 and mixed with the Dispersion E obtained above by the following composition to give a coating solution for a heat-sensitive recording layer. Furthermore, according to a similar manner to Example 1, the heat-sensitive recording material of the invention (2) was provided. The viscosity of the coating solution for a heat-sensitive recording layer was 180 mPa·s and the surface tension thereof was 36 mN/m.

| (Composition of a coating solution for a heat-sensitive-color develop layer) | |
|---|---|
| Dispersion A | 60 parts |
| Dispersion B | 120 parts |
| Dispersion C | 120 parts |
| Dispersion E | 30 parts |
| Dispersion D | 101 parts |
| Zinc stearate 30% Dispersion | 15 parts |
| Paraffin wax (30%) | 15 parts |
| Sodium carboxymethylcellulose (1% aqueous solution of Cellogen EP (manufactured by Daiichi Kogyo Seiyaku Co., Ltd.)) | 100 parts |
| Sodium dodecylbenzenesulfonate (25%) | 4 parts |

Example 3

Dispersion E-1' was prepared according to a similar manner to Example 2 except that 1,1,3-tris(2-methyl-4-hydroxy-5-cyclohexylphenyl)butane was used instead of 1,1,3-tris(2-methyl-4-hydroxy-5-tert-butylphenyl)butane (an image stabilizer) used for the preparation of the Dispersion E. Furthermore, according to the similar manner to Example 2, the heat-sensitive recording material of the invention (3) was provided. The viscosity of the coating solution for a heat-sensitive recording layer was 190 mPa·s and the surface tension thereof was 37 mN/m.

Example 4

The heat-sensitive recording materials (4) of the invention according to a similar manner to Example 1 except that amorphous silica (trade name: MIZUKASIL P832, manufactured by Mizusawa Industrial Chemicals, Ltd., 20 parts) wase used instead of calcite light calcium carbonate (UNIVER 70; inorganic pigment, 40 parts) used for the preparation of Dispersion D. The viscosity of the coating solution for a heat-sensitive recording layer was 170 mPa·s and the surface tension thereof was 37 mN/m.

Example 5

The heat-sensitive recording materials (5) of the invention according to a similar manner to Example 1 except that aluminum hydroxide (Trade name: HYGILITE H42, manufactured by Showa Denko K.K., 40 parts) wase used in place of calcite light calcium carbonate (UNIVER 70; inorganic pigment, 40 parts) used for the preparation of Dispersion D. The viscosity of the coating solution for a heat-sensitive recording layer was 190 mPa·s and the surface tension thereof was 34 mN/m.

Example 6

The heat-sensitive recording material (6) of the invention was obtained according to a similar manner to Example 1 except that a sulfo-modified polyvinyl alcohol (trade name: GOHSERAN L3266, manufactured by Nippon Synthetic Chemical Industry Co., Ltd., 2.5% aqueous solution) was used instead of polyvinyl alcohol 2.5% aqueous solution (an adhesive) used for the preparations of Dispersions A, B and C. The viscosity of the coating solution for a heat-sensitive recording layer thus prepared was 150 mPa·s and the surface tension thereof was 33 mN/m.

Example 7

The heat-sensitive recording material of the invention (7) was obtained according to a similar manner to Example 1 except that polyvinyl alcohol 2.5% aqueous solution (an adhesive) used for the preparations of Dispersions A, B and C was changed to a diacetone-modified polyvinyl alcohol (trade name: D500, manufactured by Unitika Ltd., 2.5% aqueous solution), and that adipic acid dihydrazide 5% aqueous solution (a crosslinking agent, 13 parts) was added to the coating solution for a heat-sensitive recording layer obtained by mixing the thus-obtained Dispersions A, B and C according to a similar manner to Example 1. The viscosity of the coating solution for a heat-sensitive recording layer thus prepared was 170 mPa·s and the surface tension thereof was 35 mN/m.

Example 8

The heat-sensitive recording material of the invention (8) was obtained according to a similar manner to Example 1 except that polyvinyl alcohol 2.5% aqueous solution (an adhesive) used for the preparations of Dispersions A, B and C was changed to 2.5% aqueous solution of acetoacetyl-modified polyvinyl alcohol (trade name: GOHSEFIMER Z210, manufactured by Nippon Synthetic Chemical Industry Co., Ltd.,), and that 5% aqueous solution of glyoxal (a crosslinking agent, 13 parts) was added to the coating solution for a heat-sensitive recording layer obtained by mixing the thus-obtained Dispersions A, B and C according to a similar manner to Example 1. The viscosity of the coating solution for a heat-sensitive recording layer thus prepared was 190 mPa·s and the surface tension thereof was 33 mN/m.

Example 9

The heat-sensitive recording material of the invention (9) was obtained according to a similar manner to Example 1 except that recycled paper (50 g/m$^2$) consisting of recycled pulp (70%) and LBKP (30%) and having the smoothness degree measured by JIS-8119 of 170 seconds was used instead of the quality paper used as a substrate in Example 1.

Example 10

The heat-sensitive recording material of the invention (10) was obtained according to a similar manner to Example 1 except that the method comprising applying the coating solution for a heat-sensitive recording layer obtained in Example 1 and the coating solution for a protective layer having the following composition simultaneously to form multiple layers using a curtain coater, drying and calendaring on the surface of the laminated protective layer was used instead of the method comprising applying a coating solution for a heat-sensitive recording layer, drying and calendaring after formation of an undercoat layer on a substrate in the <Preparation of a heat-sensitive recording material> of Example 1. The dried coating amount of the protective layer was 2.0 g/m$^2$.

-Preparation of a Coating Solution for a Protective Layer-

The following composition was dispersed using a sand mill, a pigment dispersion having the volume mean diameter of 2 μm was prepared. The volume mean diameter was measured according to a similar manner to Example 1.

| | |
|---|---|
| Aluminum hydroxide (average particle size 1 μm) (trade name: HYGILITE H42, manufactured by Showa Denko K.K.) | 40 parts |
| Sodium polyacrylate | 1 part |
| Water | 60 parts |

A mixture of 15% aqueous solution of urea phosphate esterified starch (trade name: MS4600, manufactured by Nihon Shokuhin Kako Co., Ltd., 200 parts), 15% aqueous solution of polyvinyl alcohol (trade name: PVA-105, manufactured by Kuraray Co., Ltd., 200 parts) and water (60 parts) was prepared separately. To the mixture were added the pigment dispersion as obtained above, and 25 parts of zinc stearate emulsified dispersion having the volume mean diameter of 0.15 μm (trade name: HYDRIN F115, manufactured by Chukyo Yushi Co., Ltd.,) and 125 parts of 2% aqueous solution of sulfosuccinic acid 2-ethylhexylester sodium salt to give a coating solution for protective layer.

Examples 11 to 13

The heat-sensitive recording materials of the invention (11) to (13) were obtained according to a similar manner to Example 6 except that aluminum hydroxide (trade name: HYGILITE H43, volume mean diameter 0.7 μm, manufactured by Showa Denko K.K., 40 parts), kaolin (trade name: KAOBRITE, volume mean diameter 2.5 μm, manufactured by Shiraishi Kogyo K.K., 40 parts) and amorphous silica (trade name: MIZUKASIL P707, volume mean diameter 2.2 μm, manufactured by Mizusawa Industrial Chemicals, Ltd., 20 parts) were used respectively instead of aluminum hydroxide (HYGILITE H42; an inorganic pigment, 40 parts) used for the preparation of the coating solution for a protective layer of Example 10. The viscosity of the coating solutions for a heat-sensitive recording layers in Examples 11 to 13 thus prepared was 38 mPa·s, 45 mPa·s and 40 mPa·s, respectively, and the surface tension thereof was 31 mN/m, 29 mN/m and 33 mN/m, respectively.

Examples 14 to 20

The heat-sensitive recording materials of the invention (14) to (20) were obtained according to a similar manner to Example 1 except that dimethylbenzyl oxalate (trade name: HS3520R-N, manufactured by Dainippon Ink and Chemicals, Inc.), m-terphenyl, ethyleneglycol tolyl ether, p-benzylbiphenyl, 1,2-diphenoxymethylbenzene, diphenylsulfone and 1,2-diphenoxyethane were used respectively, instead of 2-benzyloxynaphthalene (a sensitizer) used for the preparation of Dispersion C. The viscosity of the coating solutions for a heat-sensitive recording layers in Examples 14 to 20 thus prepared was 180 mPa·s, 190 mPa·s, 190 mPa·s, 200 mPa·s, 180 mPa·s, 180 mPa·s and 200 mPa·s, respectively, and the surface tension thereof was 35 mN/m, 34 mN/m, 35 mN/m, 34 mN/m, 36 mN/m, 34 mN/m and 35 mN/m, respectively.

Examples 21 to 25

The heat-sensitive recording materials of the invention (21) to (25) were obtained according to a similar manner to Example 1 except that 2-anilino-3-methyl-6-dibutylaminofluorane, 2-anilino-3-methyl-6-(N-ethyl-N-isoamylamino) fluorane, 2-anilino-3-methyl-6-(N-ethyl-N-propylamino) fluorane, 2-anilino-3-methyl-6-di-n-amylaminofluorane and 2-anilino-3-methyl-6-(N-ethyl-N-p-tolylamino)fluorine were used respectively instead of 2-anilino-3-methyl-6-diethylaminofluorane (an electron-donating colorless dye) used for the preparation of Dispersion A of Example 1. The viscosity of the coating solutions for a heat-sensitive recording layers in Examples 21 to 25 thus prepared was 180 mPa·s, 170 mPa·s, 190 mPa·s, 170 mPa·s, and 180 mPa·s, respectively, and the surface tension thereof was 35 mN/m, 34 mN/m, 35 mN/m, 34 mN/m and 35 mN/m, respectively.

Examples 26 to 29

The heat-sensitive recording materials (26) to (29) of the invention were obtained according to a similar manner to Example 1 except that N-benzyl-4-hydroxybenzenesulfoneamide (=p-N-benzylsulfamoylphenol), BTUM, 4-hydroxy-4'-isopropoxydiphenylsulfone and 2,4-bis(phenylsulfonyl) phenol were used, respectively, instead of 4-hydroxybenzenesulfoneanilide (an electron-accepting compound) used for the preparation of Dispersion in Example 1. The viscosity of the coating solutions for a heat-sensitive recording layers in Examples 26 to 29 thus prepared was 180 mPa·s, 190 mPa·s, 180 mPa·s, and 200 mPa·s, respectively, and the surface tension thereof was 35 mN/m, 34 mN/m, 36 mN/m and 34 mN/m, respectively.

Comparative Examples 1 and 2

The comparative heat-sensitive recording materials (30) and (31) were obtained according to a similar manner to Example 1 except that 2,2'-bis(4-hydroxyphenol)propane (bisphenol A) and 4,4'-di-hydroxydiphenylsulfone were used, respectively, instead of 4-hydroxybenzenesulfoneanilide (an electron-accepting compound) used for the preparation of Dispersion B in Example 1. The viscosity of the coating solutions for a heat-sensitive recording layers in Comparative Examples 1 and 2 thus prepared was 180 mPa·s and 180 mPa·s, respectively, and the surface tension thereof was 35 mN/m and 36 mN/m, respectively.

Comparative Example 3

The comparative heat-sensitive recording material (32) was obtained according to a similar manner to Example 1 except that 1% aqueous solution of carboxymethylcellulose used in the preparation of the coating solution for the heat-sensitive recording layer in Example 1 was changed to distilled water. The viscosity of the coating solution for the heat sensitive material was 25 mPa·s and the surface tension was 37 mN/m.

Comparative Example 4

A heat-sensitive recording material (33) was prepared by using the coating solution for the heat-sensitive recording layer in Example 1 in a similar manner to Example 1 except that an air knife coater was used in place of a curtain coater.

(Evaluation)

The heat-sensitive recording materials (1) to (29) of the present invention, and the comparative heat-sensitive recording materials (30) to (33) were subjected to measurements ans evaluation with respect to the following items. The results of measurements and evaluation are listed in Table 1 below.

(1) Measurement of Sensitivity

Using a heat-sensitive printing apparatus comprising a thermal head having partially-glazed structure (trade name: KF2003-GD31° A., manufactured by Rohm Co., Ltd.), printing was carried out. The printing was carried out under the conditions of the head voltage of 24V and the printing frequency of 0.98 ms/line (printing velocity 12.8 cm/seconds) at the pulse width of 0.375 ms (applied energy 15.2 $mJ/mm^2$), and the printing density was measured using Macbeth reflection densitometer (trade name: RD-918, manufactured by Macbeth Corporation).

(2) Evaluation of the Surface State of the Coating Layer

The surface of each heat sensitive recording material was heated to 120° C. by ironing, and observed to evaluate for the surface state of the coating layer after color had been developed according to the following criteria:

[Criteria]

○ Surface state of the coating layer is even.

Δ No practical problem occurred, although slightly uneven.

X Color development is non-uniform with serious unevenness caused.

(3) Evaluation of Background Fogging

Each of the heat-sensitive recording materials was left under the environment condition of the temperature of 60° C. and the relative humidity of 20% for 24 hours, and the density of the background portion (non-image portion) was measured using Macbeth reflection densitometer (trade name: RD-18, manufactured by Macbeth Corporation). The lower the value becomes, the better the background fogging becomes.

(4) Evaluation of Image Retention Property

The above-mentioned heat-sensitive recording material was subjected to photographic printing under the same apparatus and condition as those for the "(1) Measurement of sensitivity". Immediately after the photographic printing of the image, the image density and the image density after standing under the atmosphere of the temperature of 60° C. and the relative humidity of 20% for 24 hours using Macbeth reflection densitometer (trade name: RD-918, manufactured by Macbeth Corporation). Thereafter the ratio of the image density after standing relative to the image density immediately after printing of image (%; density retention rate) based on the following equation, which was used as an index for evaluating the image retention property. The higher the value becomes, the better the image retention property becomes.

Density retention rate=[(Image density after standing)/(Image density immediately after printing)]×100

(5) Evaluation of Chemical Resistance

The above-mentioned heat-sensitive recording material was subjected to photographic printing under the same apparatus and condition as those for the "(1) Measurement of sensitivity". On the surface of the background portion and the photographic printed portion were each written using a fluorescence pen (trade name: Zebra fluorescence pen 2-pink, manufactured by Zebra Co., Ltd.). The degree of background fogging of the background portion and the image density of the image part of the heat-sensitive recording material after 1 day were visually observed and evaluated according to the following criteria.

[Criteria]

○ Increase of background fogging density of the background part was not observed, and density change of the image part was also not observed.

Δ Increase of background fogging density of the background part was observed slightly, but the image density part was slightly low.

X Increase of background fogging density of the background part was observed significantly, and the image part was almost diminished.

(6) Evaluation of Worn-out Head

A4 size test charts (1,000 sheets) were printed at a letter-printing ratio of 20% using a word processor (trade name: Rupo 95JV, manufactured by Toshiba Corporation), and the number of defected dots was adopted as an indication of worn-out head.

(7) Evaluation of Ink Jet Applicability

[1] Ink Resistance

The above-mentioned heat-sensitive recording material was subjected to photographic printing under the same apparatus and condition as those for the "(1) Measurement of sensitivity". The image density ($D^1$) immediately after printing was measured using Macbeth reflection densitometer (trade name: RD918, manufactured by Macbeth Corporation). The surface of the heat-sensitive recording layer on which photographic printing has been provided (printing parts subjected to photographic printing) was contacted with the image that had been formed by high image quality printing using an ink jet printer (trade name: EPSON MJ930C, manufactured by Epson Inc.). The image density ($D^2$) of the heat-sensitive recording layer after standing at 25° C. for 48 hr was measured using Macbeth reflection densitometer RD918. Density retention rate (%; $D^2/D^1 \times 100$) was calculated from the obtained density for each of the heat-sensitive recording materials, which was used as an index for evaluating the ink resistance for ink jet. The higher the value becomes, the better the ink resistance becomes.

[2] Ink Jet Recording Applicability

Letters were printed on each of the heat-sensitive recording materials using a word processor (trade name: RUPO JW-95JU, manufactured by Toshiba Corporation). To the thus-printed heat-sensitive recording layer was further printed using an ink jet printer, and the blotting of the ink on the ink jet-recorded part and the fading of the letter part printed by a word processor were evaluated visually according to the following criteria.

(Criteria)

○ Blotting of ink and fading of letter parts were little and, the letters could be read without any problem.

Δ A part of letter part was squeezed out, and the letters could be read with difficulty.

X Letter part was completely diminished, and the letters could not be read.

(8) Measurement of Contact Angle

Distilled water was dropped on the surface of the heat-sensitive recording layer of the heat-sensitive recording material (a recording surface), and the contact angle after 0.1 second was measured using FIBRO system (trade name: DAT1100, manufactured by FIBRO system, ab). The greater the value becomes, the more useful the material becomes in view of its effects.

(9) Measurement of Concentration for Ions ($Na^+$ and $K^+$)

The heat-sensitive recording material was extracted with heated water respectively, and the extract was measured by ion quantitative analysis by atomic absorption method for ion masses of $Na^+$ ion and $K^+$ ion. The ion concentrations in Table 1 represents the total ion concentration for $Na^+$ and $K^+$, which shows the total ppm value relative to the total mass of the heat-sensitive recording material.

was formed by curtain coating of the coating solution having a viscosity of 30 to 300 mPa·s, the surface state of the coating layer was excellent, high color density (sensitivity) was obtained while suppressing background fogging (good printability), image storability after printing was excellent, ink-jet printing applicability was improved as the contact angle increases, chemical resistance was excellent, and head matching property of the thermal head was excellent with a reduced worn-out head. That is, the heat sensitive recording material of the invention simultaneously satisfies high sensitivity as well as improved background whiteness, image storability, ink-jet printing applicability, chemical resistance and head matching property of the thermal head (wear resistance).

As compared with the heat sensitive recording material (1), the heat sensitive recording materials (2) and (3) containing an image stabilizer have improved image storability and ink resistance, and the heat sensitive recording material (6) containing a preferable adhesive (a protective colloid) has achieved high sensitivity and suppressed background fogging. Printability and handling ability are also excellent when an image stabilizer is incorporated thereinto. Image storability and ink resistance (chemical resistance) can be further improved in the heat sensitive recording materials

TABLE 1

| | Heat sensitive recording material | Image density (Sensitivity) | Surface state of coating layer | Image storability | Background fogging density | Chemical resistance | Worn-out head | Ink-jet applicability: Ink resistance | Ink-jet applicability: Ink-jet printability | Contact angle [°] | Ion concentration [ppm] |
|---|---|---|---|---|---|---|---|---|---|---|---|
| Example 1 | [1] | 1.28 | ○ | 95% | 0.09 | ○ | 0 | 90% | ○ | 51 | 780 |
| Example 2 | (2) | 1.27 | ○ | 98% | 0.10 | ○ | 0 | 93% | ○ | 55 | 800 |
| Example 3 | (3) | 1.26 | ○ | 97% | 0.10 | ○ | 0 | 92% | ○ | 53 | 800 |
| Example 4 | (4) | 1.26 | ○ | 93% | 0.10 | ○ | 0 | 88% | ○ | 50 | 770 |
| Example 5 | (5) | 1.27 | ○ | 96% | 0.09 | ○ | 0 | 91% | ○ | 55 | 790 |
| Example 6 | (6) | 1.30 | ○ | 96% | 0.08 | ○ | 0 | 93% | ○ | 50 | 800 |
| Example 7 | (7) | 1.29 | ○ | 97% | 0.08 | ○ | 0 | 92% | ○ | 52 | 800 |
| Example 8 | (8) | 1.28 | ○ | 95% | 0.08 | ○ | 0 | 93% | ○ | 55 | 790 |
| Example 9 | (9) | 1.28 | ○ | 94% | 0.09 | ○ | 0 | 93% | ○ | 60 | 800 |
| Example 10 | (10) | 1.23 | ○ | 98% | 0.09 | ○ | 0 | 98% | ○ | 45 | 800 |
| Example 11 | (11) | 1.22 | ○ | 97% | 0.09 | ○ | 0 | 97% | ○ | 42 | 800 |
| Example 12 | (12) | 1.21 | ○ | 98% | 0.10 | ○ | 0 | 88% | ○ | 48 | 790 |
| Example 13 | (13) | 1.20 | ○ | 96% | 0.10 | ○ | 0 | 92% | ○ | 35 | 800 |
| Example 14 | (14) | 1.27 | ○ | 94% | 0.09 | ○ | 0 | 89% | ○ | 50 | 790 |
| Example 15 | (15) | 1.26 | ○ | 95% | 0.10 | ○ | 0 | 91% | ○ | 51 | 800 |
| Example 16 | (16) | 1.28 | ○ | 94% | 0.09 | ○ | 0 | 92% | ○ | 51 | 790 |
| Example 17 | (17) | 1.24 | ○ | 91% | 0.10 | ○ | 0 | 89% | ○ | 50 | 800 |
| Example 18 | (18) | 1.26 | ○ | 95% | 0.10 | ○ | 0 | 91% | ○ | 52 | 790 |
| Example 19 | (19) | 1.28 | ○ | 93% | 0.09 | ○ | 0 | 89% | ○ | 51 | 800 |
| Example 20 | (20) | 1.25 | ○ | 92% | 0.10 | ○ | 0 | 91% | ○ | 50 | 790 |
| Example 21 | (21) | 1.28 | ○ | 97% | 0.10 | ○ | 0 | 93% | ○ | 55 | 790 |
| Example 22 | (22) | 1.26 | ○ | 95% | 0.10 | ○ | 0 | 88% | ○ | 55 | 780 |
| Example 23 | (23) | 1.26 | ○ | 92% | 0.10 | ○ | 0 | 87% | ○ | 55 | 790 |
| Example 24 | (24) | 1.28 | ○ | 95% | 0.10 | ○ | 0 | 91% | ○ | 51 | 790 |
| Example 25 | (25) | 1.24 | ○ | 88% | 0.08 | ○ | 0 | 85% | ○ | 50 | 780 |
| Example 26 | (26) | 1.20 | ○ | 65% | 0.09 | Δ | 0 | 80% | Δ | 55 | 760 |
| Example 27 | (27) | 1.22 | ○ | 98% | 0.12 | ○ | 0 | 92% | ○ | 50 | 800 |
| Example 28 | (28) | 1.26 | ○ | 91% | 0.07 | ○ | 0 | 93% | ○ | 52 | 780 |
| Example 29 | (29) | 1.26 | ○ | 98% | 0.11 | ○ | 0 | 96% | ○ | 51 | 790 |
| Comparative example 1 | (30) | 1.30 | ○ | 70% | 0.08 | x | 0 | 60% | x | 45 | 790 |
| Comparative example 2 | (31) | 1.15 | ○ | 65% | 0.08 | x | 0 | 65% | x | 42 | 780 |
| Comparative example 3 | (32) | 1.23 | x | 93% | 0.09 | ○ | 0 | 92% | ○ | 49 | 780 |
| Comparative example 4 | (33) | 1.24 | Δ | 95% | 0.09 | ○ | 0 | 92% | ○ | 52 | 780 |

The results summarized in Table 1 reveal that in the heat sensitive recording materials (1) to (29) of the invention in which the heat sensitive recording layer containing the electron-donating colorless dye in combination with the electron-accepting compound represented by formula (1)

(10) to (13) having a protective layer containing a specific inorganic pigment suitable for the invention. By using the sensitizer employed in Examples 14 to 20, good performance can be obtained similarly to the heat sensitive recording material (1) in Example 1, and by using the electron-donating colorless dye employed in Examples 21 to 25, good color development and excellent image storability can be obtained while suppressing background. As confirmed by Examples 1 and 26, curtain coating provided an advantage to achieve high sensitivity. Any performances were not impaired even when the substrate contained the used waste paper pulp (Example 9).

On the other hand, in the comparative heat sensitive recording materials (30) and (31) produced without using the compound represented by formula (1) as the electron-accepting compound, not only sensitivity but also image storability, chemical resistance and ink-jet printing applicability were poor, thus failing to simultaneously meet the properties required for the heat sensitive recording material.

Both in the heat sensitive recording material (32) which was produced using the coating solution for the heat sensitive recording layer that had a viscosity outside the range of 30 to 300 mPa·s, and in the heat sensitive recording material (33) in which the coating solution for the heat sensitive recording layer was applied with an air-knife coater, a good surface state of the coating layer could not be obtained.

(Preparation of a Coating Solution for Heat-sensitive Recording Layer)

Dispersions A, B, C and D were prepared in a similar manner to Example 1.

-Preparation of a Coating Solution for Heat-sensitive Recording Layer-

The following composition was mixed to give a coating solution for a heat-sensitive recording layer.

| (Composition of a coating solution for a heat-sensitive recording layer) | |
|---|---|
| Dispersion A | 60 parts |
| Dispersion B | 120 parts |
| Dispersion C | 120 parts |
| Dispersion D | 101 parts |
| Zinc stearate 30% Dispersion | 15 parts |
| Paraffin wax (30%) | 20 parts |
| Sodium carboxymethylcellulose (1% aqueous solution of Cellogen EP manufactured by Daiichi Kogyo Seiyaku Co. Ltd) | 110 parts |
| Sodium dodecylbenzenesulfonate (25%) | 4 parts |

<Preparation of a Coating Solution for a Substrate Undercoat Layer>

The following components were mixed by stirring using a dissolver to give a Dispersion.

| | |
|---|---|
| Calcined kaolin (oil-absorption amount 75 ml/100 g) | 100 parts |
| Sodium hexametaphosphate | 1 part |
| Distilled water | 110 parts |

To 20 parts of the obtained Dispersion were then added SBR (styrene-butadiene rubber latex) and 25 parts of oxidized starch (25%) to give a coating solution for an undercoat layer on a substrate.

<Preparation of a Heat-sensitive Recording Material>

Quality paper having a smoothness degree measured by JIS-8119 of 150 seconds was prepared as a substrate. To the surface of the quality paper was applied the coating solution for a substrate undercoat layer obtained as above by a blade coater so that the coating amount after drying became 8 g/m$^2$ to give an undercoat layer. By applying the undercoat layer, the smoothness degree measured by JIS-8119 of the substrate became 350 seconds.

On the undercoat layer was then applied the coating solution for a heat-sensitive recording layer as obtained above using a curtain coater so that the coating amount after drying became 4 g/m$^2$ and dried to form a heat-sensitive recording layer. To the surface of the thus-formed heat-sensitive recording layer was then calendared to give the heat-sensitive recording material of the invention (34).

The maximum surface temperature of the heat-recording material in the constant drying process of the drying process was set at 40° C.

Example 31

Preparation of Dispersion E

The following components were dispersed and mixed using a ball mill to give Dispersion E-2 having the volume mean diameter of 0.7 μm. The volume mean diameter was measured according to a similar manner to Example 30.

| (Composition of Dispersion E) | |
|---|---|
| 1,1,3-Tris(2-methyl-4-hydroxy-5-tert-butylphenyl)butane (an image stabilizer) | 5 parts |
| 2.5% solution of polyvinyl alcohol (trade name: PVA-105, manufactured by Kuraray Co., Ltd.) | 25 parts |

-Preparation of a Coating Solution for a Heat-sensitive Recording Layer-

Dispersions A, B, C and D were prepared according to a similar manner to Example 30 and mixed with the Dispersion E obtained above by the following composition to give a coating solution for a heat-sensitive recording layer. Furthermore, according to a similar manner to Example 30, the heat-sensitive recording material (35) of the invention was provided.

| (Composition of a coating solution for a heat-sensitive color developing layer) | |
|---|---|
| Dispersion A | 60 parts |
| Dispersion B | 120 parts |
| Dispersion C | 120 parts |
| Dispersion E | 30 parts |
| Dispersion D | 101 parts |
| 30% Dispersion of zinc stearate | 15 parts |
| Paraffin wax (30%) | 15 parts |
| Sodium carboxymethylcellulose (1% aqueous solution of Cellogen EP manufactured by Daiichi Kogyo Seiyaku Co., Ltd.) | 110 parts |
| Sodium dodecylbenzenesulfonate (25%) | 4 parts |

Example 32

Dispersion E was prepared according to a similar manner to Example 31 except that 1,1,3-tris(2-methyl-4-hydroxy-5-cyclohexylphenyl)butane was used instead of 1,1,3-tris(2-methyl-4-hydroxy-5-tert-butylphenyl)butane (an image stabilizer) used for the preparation of the Dispersion E.

Furthermore, according to the similar manner to Example 31, the heat-sensitive recording material of the invention (36) was provided.

Examples 33 and 34

The heat-sensitive recording materials (36) and (37) of the invention according to a similar manner to Example 30 except that 20 parts of amorphous silica (trade name: MIZUKASIL P832, manufactured by Mizusawa Industrial Chemicals, Ltd.) and 40 parts of aluminum hydroxide (trade name: HYGILITE H42, manufactured by Showa Denko K.K.) were used respectively instead of calcite light calcium carbonate (UNIVER 70; inorganic pigment, 40 parts) used for the preparation of Dispersion D.

Example 35

The heat-sensitive recording material (39) of the invention was obtained according to a similar manner to Example 30 except that a sulfo-modified polyvinyl alcohol (trade name: GOHSERAN L3266, manufactured by Nippon Synthetic Chemical Industry Co., Ltd., 2.5% aqueous solution) was used instead of 2.5% aqueous solution of polyvinyl alcohol (an adhesive) used for the preparations of Dispersions A, B and C.

Example 36

The heat-sensitive recording material (40) of the invention was obtained according to a similar manner to Example 30 except that 2.5% aqueous solution of polyvinyl alcohol (an adhesive) used for the preparations of Dispersions A, B and C was changed to 2.5% aqueous solution of diacetone-modified polyvinyl alcohol (trade name: D500, manufactured by Unitika Ltd.), and that 13 parts of 5% aqueous solution of adipic acid dihydrazide (a crosslinking agent) was added to the coating solution for a heat-sensitive recording layer obtained by mixing the thus-obtained Dispersions A, B and C according to a similar manner to Example 30.

Example 37

The heat-sensitive recording material (41) of the invention was obtained according to a similar manner to Example 30 except that 2.5% aqueous solution of polyvinyl alcohol (an adhesive) used for the preparations of Dispersions A, B and C was changed to 2.5% aqueous solution of acetoacetyl-modified polyvinyl alcohol (trade name: GOHSEFIMER Z210, manufactured by Nippon Synthetic Chemical Industry Co., Ltd.) and that 13 parts of 5% aqueous solution of glyoxal (a crosslinking agent) was added to the coating solution for a heat-sensitive recording layer obtained by mixing the thus-obtained Dispersions A, B and C according to a similar manner to Example 30.

Example 38

The heat-sensitive recording material (42) of the invention was obtained according to a similar manner to Example 30 except that recycled paper (50 g/m$^2$) consisting of recycled pulp (70%) and LBKP (30%) and having the smoothness degree measured by JIS-P8119 of 170 seconds was used instead of the quality paper used as a substrate in Example 30.

Example 39

The heat-sensitive recording material (43) of the invention was obtained according to a similar manner to Example 30 except that the method comprising applying the coating solution for a heat-sensitive recording layer obtained in Example 30 and the coating solution for a protective layer having the following composition simultaneously to form multiple layers using a curtain coater, drying and calendaring on the surface of the laminated protective layer was used instead of the method comprising applying a coating solution for a heat-sensitive recording layer, drying and calendaring after formation of an undercoat layer on a substrate in the <Preparation of a heat-sensitive recording material> of Example 30. The dried coating amount of the protective layer was 2.0 g/m$^2$.

-Preparation of a Coating Solution for a Protective Layer-

The following composition was dispersed using a sand mill, a pigment dispersion was prepared.

| | |
|---|---|
| Aluminum hydroxide (average particle size 1 μm) (trade name: HYGILITE H42, manufactured by Showa Denko K.K.) | 40 parts |
| Sodium polyacrylate | 1 part |
| Water | 60 parts |

A mixture of 200 parts of 15% aqueous solution of urea phosphate esterified starch (trade name: MS4600, manufactured by Nihon Shokuhin Kako Co., Ltd.), 200 parts of 15% aqueous solution of polyvinyl alcohol (trade name: PVA-105, manufactured by Kuraray Co., Ltd.) and 60 parts of water was prepared separately. To the mixture were added the pigment dispersion as obtained above, and 25 parts of zinc stearate emulsified dispersion having the volume mean diameter of 0.15 μm (trade name: HYDRIN F115, manufactured by Chukyo Yushi Co., Ltd.) and 125 parts of 2% aqueous solution of sulfosuccinic acid 2-ethylhexylester sodium salt to give a coating solution for protective layer.

Examples 40 to 42

The heat-sensitive recording materials of the invention (44) to (46) were obtained according to a similar manner to Example 39 except that 40 parts of aluminum hydroxide (trade name: HYGILITE H43, volume mean diameter 0.7 μm, manufactured by Showa Denko K.K.), kaolin (trade name: KAOBRITE, volume mean diameter 2.5 μm, manufactured by Shiraishi Kogyo K.K., 40 parts) and 20 parts of amorphous silica (trade name: MIZUKASIL P707, volume mean diameter 2.2 μm, manufactured by Mizusawa Industrial Chemicals, Ltd.) were used, respectively, instead of 40 parts of aluminum hydroxide (HYGILITE H42; an inorganic pigment) used for the preparation of the coating solution for a protective layer of Example 39.

Examples 43 to 49

The heat-sensitive recording materials of the invention (47) to (53) were obtained according to a similar manner to Example 30 except that dimethylbenzyl oxalate (trade name: HS3520R-N, manufactured by Dainippon Ink and Chemicals, Inc.), m-terphenyl, ethyleneglycol tolyl ether, p-benzylbiphenyl, 1,2-diphenoxymethylbenzene, diphenylsulfone and 1,2-diphenoxyethane were used, respectively, instead of 2-benzyloxynaphthalene (a sensitizer) used for the preparation of Dispersion C of Example 30.

Examples 50 to 54

The heat-sensitive recording materials of the invention (54) to (58) were obtained according to a similar manner to Example 30 except that 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorine were used respectively instead of 2-anilino-3-methyl-6-diethylaminofluorane (an electron-donating colorless dye) used for the preparation of Dispersion A of Example 30.

Example 55

The heat-sensitive recording material of the invention (59) was obtained according to a similar manner to Example 30 except that the maximum surface temperature of the heat-recording material in the constant drying process of the drying process was set at 40° C.

Example 56

The heat-sensitive recording material of the invention (60) was obtained according to a similar manner to Example 30 except that the maximum surface temperature of the heat-recording material in the constant drying process of the drying process was set at 60° C.

Examples 57 to 60

The heat-sensitive recording materials (61) to (64) of the invention were obtained according to a similar manner to Example 30 except that N-benzyl-4-hydroxybenzenesulfoneamide (=p-N-benzylsulfamoylphenol), BTUM, 4-hydroxy-4'-isopropoxydiphenylsulfone and 2, 4-bis(phenysulfonyl) phenol were used, respectively, instead of 4-hydroxybenzenesulfoneanilide (an electron-accepting compound) used for the preparation of Dispersion B in Example 30.

Comparative Examples 5 and 6

The comparative heat-sensitive recording materials (65) and (66) were obtained according to a similar manner to Example 30 except that 2,2'-bis(4-hydroxyphenol)propane (bisphenol A) and 4,4'-di-hydroxydiphenylsulfone were used, respectively, instead of 4-hydroxybenzenesulfoneanilide (an electron-accepting compound) used for the preparation of Dispersion B in Example 30.

Comparative Example 7

The comparative heat-sensitive recording material (67) was obtained according to a similar manner to Example 30 except that the maximum surface temperature of the heat-recording material in the constant drying process of the drying process was set at 70° C.

(Evaluation)

The heat sensitive recording materials (34) to (64) of the invention obtained as above, and the comparative heat sensitive recording materials (65) to (67) were measured and evaluated for the following properties. The results of measurement and evaluation are shown in Table 2 below.

(1) Sensitivity, contact angle, ion ($Na^+$ and $K^+$) concentrations, background fogging, image storability, chemical resistance, worn-out ink head and ink-jet printing applicability were measured and evaluated by the same methods employed as in Examples 1 to 29 and Comparative Examples 1 to 4.

(2) Whiteness

Produced heat sensitive recording materials were measured for density at a surface background portion using a Macbeth reflection densitometer (RD-918 manufactured by Macbeth Co.). The smaller the value indicated, the higher whiteness obtained.

The obtained results are shown in Table 2.

TABLE 2

| | Heat sensitive recording material | Image density (Sensitivity) | Whiteness | Image storability | Background fogging density | Chemical resistance | Worn-out head | Ink-jet applicability: Ink resistance | Ink-jet applicability: Ink-jet printability | Contact angle [°] | Ion concentration [ppm] |
|---|---|---|---|---|---|---|---|---|---|---|---|
| Example 30 | (34) | 1.28 | 0.07 | 95% | 0.9 | ○ | 0 | 90% | ○ | 51 | 780 |
| Example 31 | (35) | 1.27 | 0.08 | 98% | 0.10 | ○ | 0 | 93% | ○ | 55 | 800 |
| Example 32 | (36) | 1.26 | 0.08 | 97% | 0.10 | ○ | 0 | 92% | ○ | 53 | 800 |
| Example 33 | (37) | 1.26 | 0.08 | 93% | 0.10 | ○ | 0 | 88% | ○ | 50 | 770 |
| Example 34 | (38) | 1.27 | 0.07 | 96% | 0.09 | ○ | 0 | 91% | ○ | 55 | 790 |
| Example 35 | (39) | 1.30 | 0.06 | 96% | 0.08 | ○ | 0 | 93% | ○ | 50 | 800 |
| Example 36 | (40) | 1.29 | 0.06 | 97% | 0.08 | ○ | 0 | 92% | ○ | 52 | 800 |
| Example 37 | (41) | 1.28 | 0.07 | 95% | 0.08 | ○ | 0 | 93% | ○ | 55 | 790 |
| Example 38 | (42) | 1.28 | 0.07 | 94% | 0.09 | ○ | 0 | 93% | ○ | 60 | 800 |
| Example 39 | (43) | 1.23 | 0.07 | 98% | 0.09 | ○ | 0 | 98% | ○ | 45 | 800 |
| Example 40 | (44) | 1.22 | 0.07 | 97% | 0.09 | ○ | 0 | 97% | ○ | 42 | 800 |
| Example 41 | (45) | 1.21 | 0.08 | 98% | 0.10 | ○ | 0 | 98% | ○ | 48 | 790 |
| Example 42 | (46) | 1.20 | 0.08 | 96% | 0.10 | ○ | 0 | 92% | ○ | 35 | 800 |
| Example 43 | (47) | 1.27 | 0.07 | 94% | 0.09 | ○ | 0 | 89% | ○ | 50 | 790 |
| Example 44 | (48) | 1.26 | 0.08 | 95% | 0.10 | ○ | 0 | 91% | ○ | 51 | 800 |
| Example 45 | (49) | 1.28 | 0.07 | 94% | 0.09 | ○ | 0 | 92% | ○ | 51 | 790 |
| Example 46 | (50) | 1.24 | 0.07 | 91% | 0.10 | ○ | 0 | 89% | ○ | 50 | 800 |
| Example 47 | (51) | 1.26 | 0.08 | 95% | 0.10 | ○ | 0 | 91% | ○ | 52 | 790 |
| Example 48 | (52) | 1.28 | 0.07 | 93% | 0.09 | ○ | 0 | 89% | ○ | 51 | 800 |
| Example 49 | (53) | 1.25 | 0.07 | 92% | 0.10 | ○ | 0 | 91% | ○ | 50 | 790 |
| Example 50 | (54) | 1.28 | 0.08 | 97% | 0.10 | ○ | 0 | 93% | ○ | 55 | 790 |

TABLE 2-continued

| | Heat sensitive recording material | Image density (Sensitivity) | Whiteness | Image storability | Background fogging density | Chemical resistance | Worn-out head | Ink-jet applicability: Ink resistance | Ink-jet applicability: Ink-jet printability | Contact angle [°] | Ion concentration [ppm] |
|---|---|---|---|---|---|---|---|---|---|---|---|
| Example 51 | (55) | 1.26 | 0.08 | 95% | 0.10 | ○ | 0 | 88% | ○ | 55 | 780 |
| Example 52 | (56) | 1.26 | 0.08 | 92% | 0.10 | ○ | 0 | 87% | ○ | 55 | 790 |
| Example 53 | (57) | 1.28 | 0.08 | 95% | 0.10 | ○ | 0 | 91% | ○ | 51 | 790 |
| Example 54 | (58) | 1.24 | 0.06 | 88% | 0.08 | ○ | 0 | 85% | ○ | 50 | 780 |
| Example 55 | (59) | 1.26 | 0.09 | 93% | 0.10 | ○ | 0 | 90% | ○ | 52 | 780 |
| Example 56 | (60) | 1.26 | 0.10 | 95% | 0.12 | ○ | 0 | 92% | ○ | 55 | 780 |
| Example 57 | (61) | 1.20 | 0.10 | 65% | 0.09 | Δ | 0 | 80% | Δ | 55 | 760 |
| Example 58 | (62) | 1.22 | 0.10 | 98% | 0.12 | ○ | 0 | 92% | ○ | 50 | 800 |
| Example 59 | (63) | 1.26 | 0.06 | 91% | 0.07 | ○ | 0 | 93% | ○ | 52 | 780 |
| Example 60 | (64) | 1.26 | 0.09 | 98% | 0.11 | ○ | 0 | 96% | ○ | 51 | 790 |
| Comparative example 5 | (65) | 1.30 | 0.07 | 70% | 0.08 | x | 0 | 60% | x | 45 | 790 |
| Comparative example 6 | (66) | 1.15 | 0.07 | 65% | 0.08 | x | 0 | 65% | x | 42 | 780 |
| Comparative example 7 | (67) | 1.27 | 0.18 | 90% | 0.22 | ○ | 0 | 92% | ○ | 52 | 780 |

The results summarized in Table 2 reveal that in the heat sensitive recording materials (34) to (64) of the invention in which the heat sensitive recording layer containing the electron-donating colorless dye in combination with the electron-accepting compound represented by formula (1) was formed by curtain coating of the coating solution and was dried at a highest surface temperature of 65° C. or lower during the constant rate drying process, background whiteness was high, high color developing density (high sensitivity) was obtained while suppressing background fogging (good printability), image storability after printing was excellent, the surface of the heat sensitive recording layer was applicable to ink-jet printing as the contact angle increases, chemical resistance was good and head matching property was excellent with a reduced wearing out of the head. That is, the heat sensitive recording material of the invention simultaneously satisfies high sensitivity as well as improved background whiteness, image storability, ink-jet printing applicability, chemical resistance and head matching property of the thermal head (wear resistance).

As compared with the heat sensitive recording material (34), the heat sensitive recording materials (35) and (36) containing the image stabilizer have improved image storability and ink resistance, and the heat sensitive recording material (39) containing the preferable adhesive (a protective colloid) has enhanced sensitivity and suppressed background fogging. Printability and handling ability are particularly excellent when the image stabilizer is incorporated thereinto. Image storability and ink resistance (chemical resistance) can be further improved in the heat sensitive recording materials (43) to (46) comprising the protective layer containing the specific inorganic pigment that is suitable for the invention. By using the sensitizer employed in Examples 43 to 49, good performance can be obtained similarly to the heat sensitive recording material (34) in Example 30, and by using the electron-donating colorless dye employed in Examples 50 to 54, good coloring and excellent image storability can be obtained while suppressing background fogging. As confirmed by Examples 30 and 35, curtain coating provided an advantage to achieve high sensitivity. Any performances were not impaired even when the substrate contained the used waste paper pulp (Example 38).

On the other hand, in the comparative heat sensitive recording materials (65) and (66) produced without using the compound represented by formula (1), high sensitivity could not be attained, and image storability, chemical resistance and ink-jet printing applicability were poor, thus failing to simultaneously satisfy the properties required for the heat sensitive recording material.

In the heat sensitive recording material (67) in which the highest surface temperature of the heat sensitive recording layer exceeds 65° C. during the constant rate drying process, high degree of whiteness could not be attained.

Example 61

Preparation of a Coating Solution for Heat-sensitive Recording Layer

Dispersions A, B, C and D were prepared in a similar manner to Example 1.

-Preparation of a Coating Solution for Heat-sensitive Recording Layer-

The following composition was mixed to give a coating solution for a heat-sensitive recording layer.

| (Composition of a coating solution for a heat-sensitive recording layer) | |
|---|---|
| Dispersion A | 60 parts |
| Dispersion B | 120 parts |
| Dispersion C | 120 parts |
| Dispersion D | 101 parts |
| 30% Dispersion of Zinc stearate | 15 parts |
| Paraffin wax (30%) | 15 parts |
| Sodium carboxymethylcellulose (1% aqueous solution of Cellogen EP manufactured by Daiichi Kogyo Seiyaku Co. Ltd) | 90 parts |
| 25% of sodium dodecylbenzenesulfonate | 4 parts |

<Preparation of a Coating Solution for a Substrate Undercoat Layer>

The following components were mixed by stirring using a dissolver to give a dispersion.

| | |
|---|---|
| Calcined kaolin (oil-absorption amount 75 ml/100 g) | 100 parts |
| Sodium hexametaphosphate | 1 part |
| Distilled water | 110 parts |

To 20 parts of the obtained dispersion were then added SBR (styrene-butadiene rubber latex) and 25 parts of oxidized starch (25%) to give a coating solution for an undercoat layer on a substrate.

<Preparation of a Heat-Sensitive Recording Material>

Quality paper having a smoothness degree measured by JIS-8119 of 150 seconds was prepared as a substrate. To the surface of the quality paper was applied the coating solution for a substrate undercoat layer obtained as above by a blade coater so that the coating amount after drying became 8 g/m$^2$ to give an undercoat layer. By applying the undercoat layer, the smoothness degree measured by JIS-8119 of the substrate became 350 seconds.

On the undercoat layer was then applied the coating solution for a heat-sensitive recording layer as obtained above using a curtain coater so that the coating amount after drying became 4 g/m$^2$ and dried to form a heat-sensitive recording layer. To the surface of the thus-formed heat-sensitive recording layer was then calendared to give the heat-sensitive recording material of the invention (68).

The coating speed was set to 300 m/min. and the falling speed of the liquid coating layer at the coating point was set to 30 m/min.

Example 62

Preparation of Dispersion E

The following components were dispersed and mixed using a ball mill to give Dispersion E having the volume mean diameter of 0.7 μm. The volume mean diameter was measured according to a similar manner to Example 61.

| (Composition of Dispersion E) | |
|---|---|
| 1,1,3-tris(2-methyl-4-hydroxy-5-tert-butylphenyl)butane (an image stabilizer) | 5 parts |
| 2.5% solution of polyvinyl alcohol (trade name: PVA-105, manufactured by Kuraray Co., Ltd.) | 25 parts |

-Preparation of a Coating Solution for a Heat-sensitive Recording Layer-

Dispersions A, B, C and D were prepared according to a similar manner to Example 61 and mixed with the Dispersion E obtained above by the following composition to give a coating solution for a heat-sensitive recording layer. Furthermore, according to a similar manner to Example 61, the heat-sensitive recording material (69) of the invention was provided.

| (Composition of a coating solution for a heat-sensitive color developing layer) | |
|---|---|
| Dispersion A | 60 parts |
| Dispersion B | 120 parts |
| Dispersion C | 120 parts |
| Dispersion E | 30 parts |
| Dispersion D | 101 parts |
| 30% dispersion of zinc stearate | 15 parts |
| Paraffin wax (30%) | 15 parts |
| Sodium carboxymethylcellulose (1% aqueous solution of Cellogen EP manufactured by Daiichi Kogyo Seiyaku Co., Ltd.) | 90 parts |
| 25% of sodium dodecylbenzenesulfonate | 4 parts |

Example 63

Dispersion E was prepared according to a similar manner to Example 62 except that 1,1,3-tris(2-methyl-4-hydroxy-5-cyclohexylphenyl)butane was used instead of 1,1,3-tris(2-methyl-4-hydroxy-5-tert-butylphenyl)butane (image stabilizer) used for the preparation of the Dispersion E. Furthermore, according to the similar manner to Example 62, the heat-sensitive recording material of the invention (70) was provided.

Examples 64 and 65

The heat-sensitive recording materials (64) and (65) of the invention according to a similar manner to Example 61 except that 20 parts of amorphous silica (trade name: MIZUKASIL P832, manufactured by Mizusawa Industrial Chemicals, Ltd.) and 40 parts of aluminum hydroxide (trade name: HYGILITE H42, manufactured by Showa Denko K.K.) were used, respectively, instead of 40 parts of calcite light calcium carbonate (UNIVER 70; inorganic pigment) used for the preparation of Dispersion D.

Example 66

The heat-sensitive recording material (73) of the invention was obtained according to a similar manner to Example 61 except that a 2.5% aqueous solution of sulfo-modified polyvinyl alcohol (trade name: GOHSERAN L3266, manufactured by Nippon Synthetic Chemical Industry Co. Ltd.) was used instead of 2.5% aqueous solution of polyvinyl alcohol (adhesive) used for the preparations of Dispersions A, B and C.

Example 67

The heat-sensitive recording material (74) of the invention was obtained according to a similar manner to Example 61 except that 2.5% aqueous solution of polyvinyl alcohol (adhesive) used for the preparations of Dispersions A, B and C was changed to 2.5% aqueous solution of diacetone-modified polyvinyl alcohol (trade name: D500, manufactured by Unitika Ltd.), and that 13 parts of 5% aqueous solution of adipic acid dihydrazide (crosslinking agent) was added to the coating solution for a heat-sensitive recording layer obtained by mixing the thus-obtained Dispersions A, B and C according to a similar manner to Example 61.

Example 68

The heat-sensitive recording material (75) of the invention was obtained according to a similar manner to Example 61 except that 2.5% aqueous solution of polyvinyl alcohol (adhesive) used for the preparations of Dispersions A, B and C was changed to 2.5% aqueous solution of acetoacetyl-modified polyvinyl alcohol (trade name: GOHSEFIMER Z210, manufactured by Nippon Synthetic Chemical Industry Co., Ltd.) and that 13 parts of 5% aqueous solution of glyoxal (crosslinking agent) was added to the coating solution for a heat-sensitive recording layer obtained by mixing the thus-obtained Dispersions A, B and C according to a similar manner to Example 61.

Example 69

The heat-sensitive recording material (76) of the invention was obtained according to a similar manner to Example 30 except that recycled paper (50 g/m$^2$) consisting of recycled pulp (70%) and LBKP (30%) and having the smoothness degree measured by JIS-P8119 of 170 seconds was used instead of the quality paper used as a substrate in Example 61.

Example 70

The heat-sensitive recording material (77) of the invention was obtained according to a similar manner to Example 61 except that the method comprising applying the coating solution for a heat-sensitive recording layer obtained in Example 61 and the coating solution for a protective layer having the following composition simultaneously to form multiple layers using a curtain coater, drying and calendaring on the surface of the laminated protective layer was used instead of the method comprising applying a coating solution for a heat-sensitive recording layer, drying and calendaring after formation of an undercoat layer on a substrate in the <Preparation of heat-sensitive recording material> of Example 61. The dried coating amount of the protective layer was 2.0 g/m$^2$.

-Preparation of Coating Solution for Protective Layer-

The following composition was dispersed using a sand mill, and a pigment dispersion was prepared.

| | |
|---|---|
| Aluminum hydroxide (average particle size 1 μm) (trade name: HYGILITE H42, manufactured by Showa Denko K.K.) | 40 parts |
| Sodium polyacrylate | 1 part |
| Water | 60 parts |

A mixture of 200 parts of 15% aqueous solution of urea phosphate esterified starch (trade name: MS4600, manufactured by Nihon Shokuhin Kako Co., Ltd.), 200 parts of 15% aqueous solution of polyvinyl alcohol (trade name: PVA-105, manufactured by Kuraray Co., Ltd.) and 60 parts of water was prepared separately. To the mixture were added the pigment dispersion as obtained above, and 25 parts of zinc stearate emulsified dispersion having the volume mean diameter of 0.15 μm (trade name: HYDRIN F115, manufactured by Chukyo Yushi Co., Ltd.) and 125 parts of 2% aqueous solution of sulfosuccinic acid 2-ethylhexylester sodium salt to give a coating solution for protective layer.

Examples 71 to 73

The heat-sensitive recording materials (78) to (80) of the invention were obtained according to a similar manner to Example 70 except that 40 parts of aluminum hydroxide (trade name: HYGILITE H43, volume mean diameter 0.7 μm, manufactured by Showa Denko K.K.), kaolin (trade name: KAOBRITE, volume mean diameter 2.5 μm, manufactured by Shiraishi Kogyo K.K., 40 parts) and 20 parts of amorphous silica (trade name: MIZUKASIL P707, volume mean diameter 2.2 μm, manufactured by Mizusawa Industrial Chemicals, Ltd.) were used, respectively, instead of 40 parts of aluminum hydroxide (HYGILITE H42; an inorganic pigment) used for the preparation of the coating solution for a protective layer of Example 70.

Examples 74 to 80

The heat-sensitive recording materials (81) to (87) of the invention were obtained according to a similar manner to Example 61 except that dimethylbenzyl oxalate (trade name: HS3520° R-N, manufactured by Dainippon Ink and Chemicals, Inc.), m-terphenyl, ethyleneglycol tolyl ether, p-benzylbiphenyl, 1,2-diphenoxymethylbenzene, diphenylsulfone and 1,2-diphenoxyethane were used, respectively, instead of 2-benzyloxynaphthalene (sensitizer) used for the preparation of Dispersion C of Example 61.

Examples 81 to 85

The heat-sensitive recording materials (88) to (92) of the invention were obtained according to a similar manner to Example 61 except that 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorine were used, respectively, instead of 2-anilino-3-methyl-6-diethylaminofluorane (electron-donating colorless dye) used for the preparation of Dispersion A of Example 61.

Examples 86 to 89

The heat-sensitive recording material (93) to (96) of the invention was obtained according to a similar manner to Example 61 except that N-benzyl-4-hydroxybenzenesulfoneamide (=p-benzylsulfamoyl phenol), BTUM, 4-hydroxy-4'-isopropoxydiphenylsulfone and 2,4-bis(phenylsulfonyl) phenol were used, respectively, in place of 4-hydroxybenzenesulfoneanilide (electron-accepting compound) for use in preparation of Dispersion B of Example 61.

Comparative Examples 8 and 9

The comparative heat-sensitive recording material (97) and (98) of the invention was obtained according to a similar manner to Example 61 except that 2,2'-bis(4-hydroxyphenol) propane (bisphenol A) and 4,4'-dihydroxydiphenylsulfone were used, respectively, in place of 4-hydroxybenzenesulfoneanilide (electron-accepting compound) for use in preparation of Dispersion B of Example 61.

Comparative Example 10

A comparative heat-sensitive recording material (99) was prepared in a similar manner as Example 61 except that the falling speed of the liquid coating layer at the coating point for coating the coating solution for the heat-sensitive recording material of Example 61 was changed to 12 m/min.

(Evaluation)

The heat sensitive recording materials (68) to (96) of the invention obtained as above, and the comparative heat sensitive recording materials (97) to (99) were measured and evaluated for the following properties. The results of measurement and evaluation are shown in Table 3 below.

(1) Sensitivity, background fogging, image storability, chemical resistance, worn-out ink head and ink-jet printing applicability contact angle, and ion ($Na^+$ and $K^+$) concentrations, were measured and evaluated by the same methods employed as in Examples 1 to 29 and Comparative Examples 1 to 4.

(2) Evaluation of the Surface State of the Coating Layer

The surface of each heat sensitive recording material was heated to 120° C. by ironing, and observed to evaluate for the surface state of the coating layer after color had been developed according to the following criteria:

[Criteria]

○ Surface state of the coating layer is even.

Δ No practical problem occurred, although slightly uneven.

X Color development is non-uniform with serious unevenness caused.

As compared with the heat sensitive recording material (68), the heat sensitive recording materials (69) and (70) containing the image stabilizer have improved image storability and ink resistance, and the heat sensitive recording material (73) containing the preferable adhesive (a protective colloid) has enhanced sensitivity and suppressed background fogging. Printability and handling ability are particularly excellent when the image stabilizer is incorporated thereinto. Image storability and ink resistance (chemical resistance) can be further improved in the heat sensitive recording materials (77) to (80) having the protective layer containing the specific inorganic pigment that is suitable for the invention. By using the sensitizer employed in Examples 74 to 80, good performance can be obtained similarly to the heat sensitive recording material (68) in Example 61, and by using the electron-donating colorless dye employed in Examples 81 to 85, good color development and excellent image storability can be obtained while suppressing background fogging. As confirmed by Examples 61 and 86, curtain coating provided an advantage to attain high sensitivity. Any performances were not impaired even when the substrate contained the used waste paper pulp (Example 69).

TABLE 3

| | Heat sensitive recording material | Image density (Sensitivity) | Surface state of coating layer | Image storability | Background fogging density | Chemical resistance | Worn-out head | Ink-jet applicability: Ink resistance | Ink-jet applicability: Ink-jet printability | Contact angle [°] | Ion concentration [ppm] |
|---|---|---|---|---|---|---|---|---|---|---|---|
| Example 61 | (68) | 1.28 | ○ | 95% | 0.09 | ○ | 0 | 90% | ○ | 51 | 780 |
| Example 62 | (69) | 1.27 | ○ | 98% | 0.10 | ○ | 0 | 93% | ○ | 55 | 800 |
| Example 63 | (70) | 1.26 | ○ | 97% | 0.10 | ○ | 0 | 92% | ○ | 53 | 800 |
| Example 64 | (71) | 1.26 | ○ | 93% | 0.10 | ○ | 0 | 88% | ○ | 50 | 770 |
| Example 65 | (72) | 1.27 | ○ | 96% | 0.09 | ○ | 0 | 91% | ○ | 55 | 790 |
| Example 66 | (73) | 1.30 | ○ | 96% | 0.08 | ○ | 0 | 93% | ○ | 50 | 800 |
| Example 67 | (74) | 1.29 | ○ | 97% | 0.08 | ○ | 0 | 92% | ○ | 52 | 800 |
| Example 68 | (75) | 1.28 | ○ | 95% | 0.08 | ○ | 0 | 93% | ○ | 55 | 790 |
| Example 69 | (76) | 1.28 | ○ | 94% | 0.09 | ○ | 0 | 93% | ○ | 60 | 800 |
| Example 70 | (77) | 1.23 | ○ | 98% | 0.09 | ○ | 0 | 98% | ○ | 45 | 800 |
| Example 71 | (78) | 1.22 | ○ | 97% | 0.09 | ○ | 0 | 97% | ○ | 42 | 800 |
| Example 72 | (79) | 1.21 | ○ | 98% | 0.10 | ○ | 0 | 98% | ○ | 48 | 790 |
| Example 73 | (80) | 1.20 | ○ | 96% | 0.10 | ○ | 0 | 92% | ○ | 35 | 800 |
| Example 74 | (81) | 1.27 | ○ | 94% | 0.09 | ○ | 0 | 89% | ○ | 50 | 790 |
| Example 75 | (82) | 1.26 | ○ | 95% | 0.10 | ○ | 0 | 91% | ○ | 51 | 800 |
| Example 76 | (83) | 1.28 | ○ | 94% | 0.09 | ○ | 0 | 92% | ○ | 51 | 790 |
| Example 77 | (84) | 1.24 | ○ | 91% | 0.10 | ○ | 0 | 89% | ○ | 50 | 800 |
| Example 78 | (85) | 1.26 | ○ | 95% | 0.10 | ○ | 0 | 91% | ○ | 52 | 790 |
| Example 79 | (86) | 1.28 | ○ | 93% | 0.09 | ○ | 0 | 89% | ○ | 51 | 800 |
| Example 80 | (87) | 1.25 | ○ | 92% | 0.10 | ○ | 0 | 91% | ○ | 50 | 790 |
| Example 81 | (88) | 1.28 | ○ | 97% | 0.10 | ○ | 0 | 93% | ○ | 55 | 790 |
| Example 82 | (89) | 1.26 | ○ | 95% | 0.10 | ○ | 0 | 88% | ○ | 55 | 780 |
| Example 83 | (90) | 1.26 | ○ | 92% | 0.10 | ○ | 0 | 87% | ○ | 55 | 790 |
| Example 84 | (91) | 1.28 | ○ | 95% | 0.10 | ○ | 0 | 91% | ○ | 51 | 790 |
| Example 85 | (92) | 1.24 | ○ | 88% | 0.08 | ○ | 0 | 85% | ○ | 50 | 780 |
| Example 86 | (93) | 1.20 | ○ | 65% | 0.09 | Δ | 0 | 80% | Δ | 55 | 760 |
| Example 87 | (94) | 1.22 | ○ | 98% | 0.12 | ○ | 0 | 92% | ○ | 50 | 800 |
| Example 88 | (95) | 1.26 | ○ | 91% | 0.07 | ○ | 0 | 93% | ○ | 52 | 780 |
| Example 89 | (96) | 1.26 | ○ | 98% | 0.11 | ○ | 0 | 96% | ○ | 51 | 790 |
| Comparative example 8 | (97) | 1.30 | ○ | 70% | 0.08 | x | 0 | 60% | x | 45 | 790 |
| Comparative example 9 | (98) | 1.15 | ○ | 65% | 0.08 | x | 0 | 65% | x | 42 | 780 |
| Comparative example 10 | (99) | 1.27 | x | 90% | 0.22 | ○ | 0 | 92% | ○ | 52 | 780 |

The results summarized in Table 3 reveal that in the heat sensitive recording materials (68) to (96) of the invention in which the heat sensitive recording layer containing the electron-donating colorless dye in combination with the electron-accepting compound represented by formula (1) was formed by curtain coating at a coating speed of 200 to 2,000 m/minute and specifying a falling speed of the coating solution in the form of a film at the coating point within 1/40 to 1 time of the coating speed, the surface state of the coating layer was good, high color density (high sensitivity) was obtained while suppressing background fogging (good printability), image storability after printing was excellent, the surface of the heat sensitive recording layer was applicable to ink-jet printing as the contact angle increases, chemical resistance was good, and head matching property of the thermal head was excellent with a reduced worn-out thermal head. That is, the heat sensitive coating material of the invention simultaneously satisfies high sensitivity, background whiteness, ink-jet printing applicability, chemical resistance and head matching property of the thermal head (wear resistance).

On the other hand, in the comparative heat sensitive recording materials (97) and (99) produced without using the compound represented by formula (1), high sensitivity could not be attained, and image storability, chemical resistance and ink-jet printing applicability were poor, thus failing to simultaneously satisfy the properties required for the heat sensitive recording material.

In the heat sensitive recording material (99) in which the falling speed of the coating solution in the form of a film at the coating point was 12 m/minutes, namely, the falling speed of the coating solution in the form of a film at the falling point fell outside the range of 1/40 to 1 time of the coating speed, good surface state of the coating layer could not be obtained.

Example 90

Heat-sensitive recording materials of the present invention were prepared according to the following processes including structural components and coating method, so as to form a density of 1.20 or higher at an application energy of 15.2 mJ/mm$^2$ by a thermal head.

(Preparation of Coating Solution for Heat-sensitive Recording Layer)

Dispersions A, B, C and D were prepared in a similar manner to Example 1.

-Preparation of a Coating Solution for Heat-sensitive Recording Layer-

The following composition was mixed to give a coating solution for a heat-sensitive recording layer.

| (Composition of a coating solution for a heat-sensitive recording layer) | |
|---|---|
| Dispersion A | 60 parts |
| Dispersion B | 120 parts |
| Dispersion C | 120 parts |
| Dispersion D | 101 parts |
| 30% Dispersion of Zinc stearate | 15 parts |
| Paraffin wax (30%) | 15 parts |
| 25% of sodium dodecylbenzenesulfonate | 4 parts |

<Preparation of a Coating Solution for a Substrate Undercoat Layer>

The following components were mixed by stirring using a dissolver to give a dispersion.

| | |
|---|---|
| Calcined kaolin (oil-absorption amount 75 ml/100 g) | 100 parts |
| Sodium hexametaphosphate | 1 part |
| Water | 110 parts |

To the obtained dispersion were then added 20 parts of SBR (styrene-butadiene rubber latex) and 25 parts of oxidized starch (25%) to give a coating solution for an undercoat layer on a substrate.

<Preparation of a Heat-sensitive Recording Material>

Quality paper having a smoothness degree measured by JIS-P8119 of 150 seconds was prepared as a substrate. To the surface of the quality paper was applied the coating solution for a substrate undercoat layer obtained as above by a blade coater so that the coating amount after drying became 8 g/m$^2$ to give an undercoat layer. By applying the undercoat layer, the smoothness degree measured by JIS-P8119 of the substrate became 350 seconds.

On the undercoat layer was then applied the coating solution for a heat-sensitive recording layer as obtained above using a curtain coater so that the coating amount after drying became 4 g/m$^2$ and dried to form a heat-sensitive recording layer. To the surface of the thus formed heat-sensitive recording layer was then calendared to give the heat-sensitive recording material (100) of the invention.

The developed color density of the resultant heat-sensitive recording material (100) was measured by a Macbeth Reflection Densitometer RD-918 at the condition and method similar to the following evaluation and was 1.28 at the application energy of 15.2 J/mm$^2$.

Example 91

Preparation of Dispersion E

The following components were dispersed and mixed using a ball mill to give Dispersion E having the volume mean diameter of 0.7 μm. The volume mean diameter was measured according to a similar manner to Example 90.

| (Composition of Dispersion E) | |
|---|---|
| 1,1,3-tris(2-methyl-4-hydroxy-5-tert-butylphenyl)butane (image stabilizer) | 5 parts |
| 2.5% solution of polyvinyl alcohol (trade name: PVA-105, manufactured by Kuraray Co., Ltd.) | 25 parts |

-Preparation of a Coating Solution for a Heat-sensitive Recording Layer-

Dispersions A, B, C and D were prepared according to a similar manner to Example 90 and mixed with the Dispersion E obtained above by the following composition to give a coating solution for a heat-sensitive recording layer. Furthermore, according to a similar manner to Example 90, the heat-sensitive recording material (101) of the invention was provided.

| (Composition of a coating solution for a heat-sensitive color developing layer) | |
|---|---|
| Dispersion A | 60 parts |
| Dispersion B | 120 parts |
| Dispersion C | 120 parts |
| Dispersion E | 30 parts |
| Dispersion D | 101 parts |
| 30% dispersion of zinc stearate | 15 parts |
| Paraffin wax (30%) | 15 parts |
| 25% of sodium dodecylbenzenesulfonate | 3 parts |

Example 92

Dispersion E was prepared according to a similar manner to Example 91 except that 1,1,3-tris(2-methyl-4-hydroxy-5-cyclohexylphenyl)butane was used instead of 1,1,3-tris(2-methyl-4-hydroxy-5-tert-butylphenyl)butane (image stabilizer) used for the preparation of the Dispersion E in a manner similar to Example 2. Furthermore, according to the similar manner to Example 91, the heat-sensitive recording material of the invention (102) was provided.

Examples 93 and 94

The heat-sensitive recording materials (103) and (104) of the invention according to a similar manner to Example 90 except that 20 parts of amorphous silica (trade name: MIZUKASIL P832, manufactured by Mizusawa Industrial Chemicals, Ltd.) and 40 parts of aluminum hydroxide (trade name: HYGILITE H42, manufactured by Showa Denko K.K.) were used, respectively, instead of 40 parts of calcite light calcium carbonate (UNIVER 70; inorganic pigment) used for the preparation of Dispersion D.

Example 95

The heat-sensitive recording material (105) of the invention was obtained according to a similar manner to Example 90 except that a 2.5% aqueous solution of sulfo-modified polyvinyl alcohol (trade name: GOHSERAN L3266, manufactured by Nippon Synthetic Chemical Industry Co. Ltd.) was used instead of 2.5% aqueous solution of polyvinyl alcohol (adhesive) used for the preparations of Dispersions A, B and C.

Example 96

The heat-sensitive recording material (106) of the invention was obtained according to a similar manner to Example 90 except that 2.5% aqueous solution of polyvinyl alcohol (adhesive) used for the preparations of Dispersions A, B and C was changed to 2.5% aqueous solution of diacetone-modified polyvinyl alcohol (trade name: D500, manufactured by Unitika Ltd.), and that 13 parts of 5% aqueous solution of adipic acid dihydrazide (crosslinking agent) was added to the coating solution for a heat-sensitive recording layer obtained by mixing the thus-obtained Dispersions A, B and C according to a similar manner to Example 90.

Example 97

The heat-sensitive recording material (107) of the invention was obtained according to a similar manner to Example 90 except that 2.5% aqueous solution of polyvinyl alcohol (adhesive) used for the preparations of Dispersions A, B and C was changed to 2.5% aqueous solution of acetoacetyl-modified polyvinyl alcohol (trade name: GOHSEFIMER Z210, manufactured by Nippon Synthetic Chemical Industry Co., Ltd.) and that 13 parts of 5% aqueous solution of glyoxal (crosslinking agent) was added to the coating solution for a heat-sensitive recording layer obtained by mixing the thus-obtained Dispersions A, B and C according to a similar manner to Example 1.

Example 98

The heat-sensitive recording material (108) of the invention was obtained according to a similar manner to Example 90 except that recycled paper (50 g/m$^2$) consisting of recycled pulp (70%) and LBKP (30%) and having the smoothness degree measured by JIS-P8119 of 170 seconds was used instead of the quality paper used as a substrate in Example 90.

Example 99

The heat-sensitive recording material (109) of the invention was obtained according to a similar manner to Example 90 except that the method comprising applying the coating solution for a heat-sensitive recording layer obtained in Example 90 and the coating solution for a protective layer having the following composition simultaneously to form multiple layers using a curtain coater, drying and calendaring on the surface of the laminated protective layer was used instead of the method comprising applying a coating solution for a heat-sensitive recording layer, drying and calendaring after formation of an undercoat layer on a substrate in the <Preparation of heat-sensitive recording material> of Example 90. The dried coating amount of the protective layer was 2.0 g/m$^2$.

-Preparation of Coating Solution for Protective Layer-

The following composition was dispersed using a sand mill, and a pigment dispersion was prepared. The volume mean particle diameter was measured by a method similar to that of Example 90.

| | |
|---|---|
| Aluminum hydroxide (average particle size 1 μm) (trade name: HYGILITE H42, manufactured by Showa Denko K.K.) | 40 parts |
| Sodium polyacrylate | 1 part |
| Water | 60 parts |

A mixture of 200 parts of 15% aqueous solution of urea phosphate esterified starch (trade name: MS4600, manufactured by Nihon Shokuhin Kako Co., Ltd.), 200 parts of 15% aqueous solution of polyvinyl alcohol (trade name: PVA-105, manufactured by Kuraray Co., Ltd.) and 60 parts of water was prepared separately. To the mixture were added the pigment dispersion as obtained above, and 25 parts of zinc stearate emulsified dispersion having the volume mean diameter of 0.15 μm (trade name: HYDRIN F115, manufactured by Chukyo Yushi Co., Ltd.) and 125 parts of 2% aqueous solution of sulfosuccinic acid 2-ethylhexylester sodium salt to give a coating solution for protective layer.

Examples 100 to 102

The heat-sensitive recording materials (110) to (112) of the invention were obtained according to a similar manner to Example 99 except that 40 parts of aluminum hydroxide (trade name: HYGILITE H43, volume mean diameter 0.7 μm, manufactured by Showa Denko K.K.), kaolin (trade name: KAOBRITE, volume mean diameter 2.5 μm, manufactured by Shiraishi Kogyo K.K., 40 parts) and 20 parts of amorphous silica (trade name: MIZUKASIL P707, volume mean diameter 2.2 μm, manufactured by Mizusawa Industrial Chemicals, Ltd.) were used, respectively, instead of 40 parts of aluminum hydroxide (HYGILITE H42; an inorganic pigment) used for the preparation of the coating solution for a protective layer of Example 99.

Examples 103 to 109

The heat-sensitive recording materials (113) to (119) of the invention were obtained according to a similar manner to Example 90 except that dimethylbenzyl oxalate (trade name: HS3520R-N, manufactured by Dainippon Ink and Chemicals, Inc.), m-terphenyl, ethyleneglycol tolyl ether, p-benzylbiphenyl, 1,2-diphenoxymethylbenzene, diphenylsulfone and 1,2-diphenoxyethane were used, respectively, instead of 2-benzyloxynaphthalene (sensitizer) used for the preparation of Dispersion C of Example 90.

Examples 110 to 114

The heat-sensitive recording materials (120) to (124) of the invention were obtained according to a similar manner to Example 90 except that 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorine were used, respectively, instead of 2-anilino-3-methyl-6-diethylaminofluorane (electron-donating colorless dye) used for the preparation of Dispersion A of Example 90.

Examples 115 to 118

The heat-sensitive recording material (125) to (128) of the invention was obtained according to a similar manner to Example 90 except that N-benzyl-4-hydroxybenzenesulfoneamide (=p-benzylsulfamoyl phenol), BTUM, 4-hydroxy-4'-isopropoxydiphenylsulfone and 2,4-bis(phenylsulfonyl) phenol were used, respectively, in place of 4-hydroxybenzenesulfoneanilide (electron-accepting compound) for use in preparation of Dispersion B of Example 90.

Comparative Examples 11 and 12

The comparative heat-sensitive recording material (129) and (130) of the invention was obtained according to a similar manner to Example 90 except that 2,2'-bis(4-hydroxyphenol) propane (bisphenol A) and 4,4'-dihydroxydiphenylsulfone were used, respectively, in place of 4-hydroxybenzenesulfoneanilide (electron-accepting compound) for use in preparation of Dispersion B of Example 90.

Comparative Example 13

A comparative heat-sensitive recording material (131) was prepared in a similar manner as Example 90 except that an amount of 4-hydroxybenzene sulfoneanilide (electron-accepting compound) used in preparation of Dispersion B of Example 90 was changed from 20 parts to 4 parts.

Comparative Example 14

A comparative heat sensitive recording material (132) was obtained in the same manner as in Example 90, except that a high-quality paper sheet having a lubricity as standardized in JIS-P8119 of 150 seconds was changed to a high-quality paper sheet having a lubricity of 50 seconds, and no calendering was carried out after the heat sensitive recording layer had been formed.

Comparative Example 15

A comparative heat sensitive recording material (133) was produced in the same manner as in Example 90, except that a blade coater was employed in place of the curtain coater for applying the coating solution for the heat sensitive recording layer.

[Evaluation]

Heat sensitive recording materials (100) to (128) of the invention, and comparative heat sensitive recording materials (129) to (133) were measured and evaluated as follows. The obtained results of measurement and evaluation are shown in Table 4 below.

(1) Sensitivity, contact angle, ion ($Na^+$ and $K^+$) concentrations, background fogging, image storability, chemical resistance, worn-out ink head and ink-jet printing applicability were measured and evaluated by the same methods as employed in Examples 1 to 29 and Comparative examples 1 to 4.

(2) Central line average roughness ($R_{a75}$) was measured according to the method standardized in JIS-B0601 (1994).

(3) Measurement of color developing un-uniformity

An extent of color development un-uniformity of respective heat sensitive recording materials was observed visually by printing an image with a pulse width of 0.188 ms (applied energy 7.6 J/mm$^2$) using the same apparatus and under the same conditions as employed in measurement of sensitivity in Item (1). The results were assessed according to the following criteria:

[Criteria]

○ Almost uniform color development is observed, without generating un-uniform color development.

X Seriously un-uniform color development is observed.

Table 4 shows the obtained results.

TABLE 4

| | Heat sensitive recording material | Image density (Sensitivity) | $R_{a75}$ | Color development un-uniformity | Image storability | Background fogging density | Chemical resistance | Worn-out head | Ink-jet applicability: Ink resistance | Ink-jet applicability: Ink-jet printability | Contact angle [°] | Ion concentration [ppm] |
|---|---|---|---|---|---|---|---|---|---|---|---|---|
| Example 90 | (100) | 1.28 | 1.1 | ○ | 95% | 0.09 | ○ | 0 | 90% | ○ | 51 | 780 |
| Example 91 | (101) | 1.27 | 1.1 | ○ | 98% | 0.10 | ○ | 0 | 93% | ○ | 55 | 800 |
| Example 92 | (102) | 1.26 | 1.1 | ○ | 97% | 0.10 | ○ | 0 | 92% | ○ | 53 | 800 |
| Example 93 | (103) | 1.26 | 1.0 | ○ | 93% | 0.10 | ○ | 0 | 88% | ○ | 50 | 770 |
| Example 94 | (104) | 1.27 | 1.1 | ○ | 96% | 0.09 | ○ | 0 | 91% | ○ | 55 | 790 |
| Example 95 | (105) | 1.30 | 1.1 | ○ | 96% | 0.08 | ○ | 0 | 93% | ○ | 50 | 800 |
| Example 96 | (106) | 1.29 | 1.1 | ○ | 97% | 0.08 | ○ | 0 | 92% | ○ | 52 | 800 |
| Example 97 | (107) | 1.28 | 1.1 | ○ | 95% | 0.08 | ○ | 0 | 93% | ○ | 55 | 790 |
| Example 98 | (108) | 1.28 | 1.5 | ○ | 94% | 0.09 | ○ | 0 | 93% | ○ | 60 | 800 |
| Example 99 | (109) | 1.23 | 0.6 | ○ | 98% | 0.09 | ○ | 0 | 98% | ○ | 45 | 800 |
| Example 100 | (110) | 1.22 | 0.5 | ○ | 97% | 0.09 | ○ | 0 | 97% | ○ | 42 | 800 |
| Example 101 | (111) | 1.21 | 0.7 | ○ | 98% | 0.10 | ○ | 0 | 98% | ○ | 48 | 790 |
| Example 102 | (112) | 1.20 | 0.5 | ○ | 96% | 0.10 | ○ | 0 | 92% | ○ | 35 | 800 |
| Example 103 | (113) | 1.27 | 1.1 | ○ | 94% | 0.09 | ○ | 0 | 89% | ○ | 50 | 790 |
| Example 104 | (114) | 1.26 | 1.0 | ○ | 95% | 0.10 | ○ | 0 | 91% | ○ | 51 | 800 |
| Example 105 | (115) | 1.28 | 1.1 | ○ | 94% | 0.09 | ○ | 0 | 92% | ○ | 51 | 790 |
| Example 106 | (116) | 1.24 | 1.1 | ○ | 91% | 0.10 | ○ | 0 | 89% | ○ | 50 | 800 |
| Example 107 | (117) | 1.26 | 1.1 | ○ | 95% | 0.10 | ○ | 0 | 91% | ○ | 52 | 790 |
| Example 108 | (118) | 1.28 | 1.1 | ○ | 93% | 0.09 | ○ | 0 | 89% | ○ | 51 | 800 |
| Example 109 | (119) | 1.25 | 1.0 | ○ | 92% | 0.10 | ○ | 0 | 91% | ○ | 50 | 790 |

TABLE 4-continued

| | Heat sensitive recording material | Image density (Sensitivity) | $R_{a75}$ | Color development un-uniformity | Image storability | Background fogging density | Chemical resistance | Worn-out head | Ink-jet applicability: Ink resistance | Ink-jet applicability: Ink-jet printability | Contact angle [°] | Ion concentration [ppm] |
|---|---|---|---|---|---|---|---|---|---|---|---|---|
| Example 110 | (120) | 1.28 | 1.0 | ○ | 97% | 0.10 | ○ | 0 | 93% | ○ | 55 | 790 |
| Example 111 | (121) | 1.26 | 1.1 | ○ | 95% | 0.10 | ○ | 0 | 88% | ○ | 55 | 780 |
| Example 112 | (122) | 1.26 | 1.0 | ○ | 92% | 0.10 | ○ | 0 | 87% | ○ | 55 | 790 |
| Example 113 | (123) | 1.28 | 1.1 | ○ | 95% | 0.10 | ○ | 0 | 91% | ○ | 51 | 790 |
| Example 114 | (124) | 1.24 | 1.1 | ○ | 88% | 0.08 | ○ | 0 | 85% | ○ | 50 | 780 |
| Example 115 | (125) | 1.20 | 1.0 | ○ | 65% | 0.09 | Δ | 0 | 80% | Δ | 55 | 760 |
| Example 116 | (126) | 1.22 | 1.0 | ○ | 98% | 0.12 | ○ | 0 | 92% | ○ | 50 | 800 |
| Example 117 | (127) | 1.26 | 1.0 | ○ | 91% | 0.07 | ○ | 0 | 93% | ○ | 52 | 780 |
| Example 118 | (128) | 1.26 | 1.0 | ○ | 98% | 0.11 | ○ | 0 | 96% | ○ | 51 | 790 |
| Comparative example 11 | (129) | 1.30 | 1.1 | ○ | 70% | 0.08 | x | 0 | 60% | x | 45 | 790 |
| Comparative example 12 | (130) | 1.15 | 1.1 | ○ | 65% | 0.08 | x | 0 | 65% | x | 42 | 780 |
| Comparative example 13 | (131) | 1.05 | 1.0 | ○ | 50% | 0.09 | Δ | 0 | 55% | Δ | 45 | 760 |
| Comparative example 14 | (132) | 1.20 | 2.5 | x | 94% | 0.09 | ○ | 0 | 90% | ○ | 55 | 780 |
| Comparative example 15 | (133) | 1.25 | 0.8 | x | 95% | 0.09 | ○ | 0 | 88% | ○ | 49 | 790 |

The results summarized in Table 4 reveal that in the heat sensitive recording materials (100) to (128) of the invention in which the heat sensitive recording layer containing the compound represented by formula (1) was formed by curtain coating of the respective coating solutions and specifying a central line average roughness ($R_{a75}$) at the surface of the heat sensitive recording layer in the range of 2.0 μm or less, high color developing density (high sensitivity) was obtained while suppressing background fogging (good printability), image storability after printing was excellent, the surface of the heat sensitive recording layer was applicable to ink-jet printing as the contact angle increases, chemical resistance was good, a head matching property of the thermal head was excellent with a reduced worn-out thermal head. That is, the heat sensitive coating material of the invention simultaneously satisfies high sensitivity, background whiteness, image storability, ink-jet printing applicability, chemical resistance and head matching property of the thermal head (wear resistance).

As compared with the heat sensitive recording material (100), the heat sensitive recording materials (101) and (102) containing the image stabilizer have improved image storability and ink resistance, and the heat sensitive recording material (105) containing the preferable adhesive (a protective colloid) has enhanced sensitivity and suppressed background fogging. Printability and handling performance are particularly excellent when the image stabilizer is incorporated thereinto. Image storability and ink resistance (chemical resistance) can be further improved in the heat sensitive recording materials (109) to (112) comprising the protective layer containing the specific inorganic pigment that is suitable for the invention. By using the sensitizer employed in Examples 103 to 109, good performance can be obtained similarly to the heat sensitive recording material (1) in Example 90, and by using the electron-donating colorless dye employed in Examples 110 to 114, good color development and excellent image storability can be obtained while suppressing background fogging. No performance impairment was observed even when the substrate contained the used paper pulp (Example 98).

On the other hand, in the comparative heat sensitive recording materials (129) to (131) produced without using the compound represented by formula (1), high sensitivity could not be attained, and image storability, chemical resistance and ink-jet printing applicability were poor. In the comparative heat-resistant recording material (132) having a central line average roughness ($R_{a75}$) at the surface of the heat sensitive recording layer of 2.0 μm or more, and in the comparative heat-resistant recording material (133) having a heat sensitive recording layer formed by a blade coater, color development un-uniformity was noticeable.

As detailed above, the present invention provides a heat sensitive recording material * * * having a good surface state of the coating layer, wherein coloring unevenness is suppressed, the background (non-image portion) has high whiteness, high density images are formed with a high image density while suppressing fogging density (background fogging) low (good printability), image storability after printing and chemical resistance are excellent, and the recording surface is favorably compatibility with ink-jet printing without causing poor hue and blurring of the ink-jet image and image fading ascribed to ink-jet inks, while head matching property of the thermal head is excellent (good compatibility of the head) with no wear and contamination of the head even when the heat sensitive recording material is used for a high speed high performance printer having a partial glaze structure.

INDUSTRIAL APPLICABILITY

The present invention provides a heat sensitive recording material that is capable of obtaining a clear and high quality image, excellent in light fastness of image forming, and being able to print on a heat sensitive recording layer or protective layer without blurring. The heat sensitive recording material of the invention is widely applicable to FAX and various printers. The heat sensitive recording material of the invention is industrially useful since it is suitable for daily uses. The invention has a large industrial applicability in that it is able to sufficiently comply with social demands considering the environment since the heat sensitive recording material of the invention is produced using a small amount of the coating solution with a low production cost while the heat sensitive recording material has a plain paper sheet-like feeling, if necessary.

The invention claimed is:

1. A heat-sensitive recording material comprising a substrate and a heat-sensitive recording layer provided thereon, the layer comprising an electron-donating colorless dye and an electron-accepting compound that reacts with the electron-donating colorless dye to develop color, wherein the electron-accepting compound is 4-hydroxybenzenesulfoanilide, and at least the heat-sensitive recording layer is formed by curtain-coating a coating solution for the heat-sensitive recording layer.

2. A heat-sensitive recording material according to claim 1, wherein the viscosity of the coating solution is 30 to 300 mPa·s.

3. A heat-sensitive recording material according to claim 2, wherein the heat-sensitive recording layer is formed by coating the coating solution in an amount of 5 g/m$^2$ or less.

4. A heat-sensitive recording material according to claim 2, wherein the surface tension of the coating solution is 25 to 50 mN/m.

5. A heat-sensitive recording material according to claim 2, wherein a protective layer is provided on the heat-sensitive layer, and the protective layer contains at least one inorganic pigment selected from aluminum hydroxide, kaolin and amorphous silica, and a water-soluble polymer.

6. A heat-sensitive recording material according to claim 2, wherein the heat-sensitive recording layer comprises a sensitizer, and the sensitizer is at least one compound selected from 2-benzyloxynaphthalene, dimethylbenzyl oxalate, m-terphenyl, ethyleneglycoltolylether. p-benzylbiphenl, 1,2-diphenoxymethylbenzene, diphenylsulfone and 1,2-diphenoxyethane.

7. A heat-sensitive recording material according to claim 1, wherein the electron-donating colorless dye is at least one selected from 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorane.

8. A heat-sensitive recording material according to claim 1, wherein at least the heat sensitive recording layer is dried at a highest surface temperature of 65° C. or lower during a constant rate drying process.

9. A heat-sensitive recording material according to claim 8, wherein the heat-sensitive recording layer comprises a sensitizer, and the sensitizer is at least one compound selected from 2-benzyloxynaphthalene, dimethylbenzyl oxalate, m-terphenyl, ethyleneglycoltolylether. p-benzylbiphenl, 1,2-diphenoxymethylbenzene, diphenylsulfone and 1,2-diphenoxyethane.

10. A heat-sensitive recording material according to claim 8, wherein the electron-donating colorless dye is at least one selected from 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorane.

11. The heat-sensitive recording material according to claim 1, wherein the coating solution is coated at a coating speed of 200 to 2,000 m/minute and a falling speed of the coating solution in the form of a film at the coating point is at a ratio of 1/40 to 1 of the coating speed.

12. A heat-sensitive recording material according to claim 11, wherein the heat-sensitive recording layer comprises a sensitizer, and the sensitizer is at least one compound selected from 2-benzyloxynaphthalene, dimethylbenzyl oxalate, m-terphenyl, ethyleneglycoltolylether. p-benzylbiphenl, 1,2-diphenoxymethylbenzene, diphenylsulfone and 1,2-diphenoxyethane.

13. A heat-sensitive recording material according to claim 11, wherein the electron-donating colorless dye is at least one selected from 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorane.

14. A heat-sensitive recording material according to claim 1, wherein the central line average roughness ($R_{a75}$) at the surface of the heat sensitive recording layer is 2.0 μm or less.

15. A heat-sensitive recording material according to claim 14, wherein the central line average roughness ($R_{a75}$) at the surface of the heat sensitive recording layer is from 0.5 μm to 2.0 μm or less.

16. The heat-sensitive recording material according to claim 14, wherein the heat sensitive recording layer contains an inorganic pigment that is at least one selected from calcite-structured (light) calcium carbonate, amorphous silica and aluminum hydroxide.

17. The heat-sensitive recording material according to claim 14, wherein the support contains waste paper pulp.

18. The heat-sensitive recording material according to claim 14, wherein the heat-sensitive recording material has a protective layer thereon, and the protective layer contains at least one inorganic pigment selected from aluminum hydroxide, kaolin and amorphous silica, in combination with a water-soluble polymer.

19. The heat-sensitive recording material according to claim 14, wherein the heat sensitive recording layer contains a sensitizer that is at least one selected from 2-benzyloxynaphthalene, dimethylbenzyl oxalate, m-terphenyl, ethyleneglycol tolylether, p-benzyl biphenyl, 1,2-diphenoxymethylbenzene, diphenyl sulfone and 1,2-diphenoxyethane.

20. The heat-sensitive recording material according to claim 14, wherein the electron-donating colorless dye is at least one selected from 2-anilino-3-methyl-6-diethylaminofluorane, 2-anilino-3-methyl-6-dibutylaminofluorane, 2-anilino-3-methyl-6-(N-ethyl-N-isoamylamino)fluorane, 2-anilino-3-methyl-6-(N-ethyl-N-propylamino)fluorane, 2-anilino-3-methyl-6-di-n-amylaminofluorane and 2-anilino-3-methyl-6-(N-ethyl-N-p-tolylamino)fluorane.

* * * * *